US009227196B2

(12) United States Patent
Hassan et al.

(10) Patent No.: US 9,227,196 B2
(45) Date of Patent: Jan. 5, 2016

(54) METHOD OF HIGH SHEAR COMMINUTION OF SOLIDS

(71) Applicant: H R D Corporation, Sugar Land, TX (US)

(72) Inventors: Abbas Hassan, Sugar Land, TX (US); Aziz Hassan, Sugar Land, TX (US); Rayford G. Anthony, College Station, TX (US); Gregory G. Borsinger, Chatham, NJ (US)

(73) Assignee: H R D Corporation, Houston, TX (US)

( * ) Notice: Subject to any disclaimer, the term of this patent is extended or adjusted under 35 U.S.C. 154(b) by 348 days.

(21) Appl. No.: 13/790,733

(22) Filed: Mar. 8, 2013

(65) Prior Publication Data

US 2014/0209714 A1 Jul. 31, 2014

Related U.S. Application Data

(60) Provisional application No. 61/756,919, filed on Jan. 25, 2013.

(51) Int. Cl.

| | |
|---|---|
| ***B02C 23/08*** | (2006.01) |
| ***C10G 1/04*** | (2006.01) |
| ***C10G 31/08*** | (2006.01) |

(52) U.S. Cl.

CPC ..... *B02C 23/08* (2013.01); *C10G 1/045* (2013.01); *C10G 31/08* (2013.01)

(58) Field of Classification Search

CPC ..... B02C 23/08; B02C 23/18; C10G 1/045; C10G 31/08

USPC ..... 241/15, 21, 29, 24.1

See application file for complete search history.

(56) References Cited

U.S. PATENT DOCUMENTS

| | | | |
|---|---|---|---|
| 3,523,887 | A | 8/1970 | Hanson et al. |
| 3,884,798 | A | 5/1975 | Hilfman et al. |

(Continued)

FOREIGN PATENT DOCUMENTS

| | | |
|---|---|---|
| WO | 02064708 A2 | 8/2002 |
| WO | 2009002960 | 12/2008 |
| WO | 2011062737 | 5/2011 |

OTHER PUBLICATIONS

Search Report and Written Opinion dated Oct. 22, 2013 for International Application No. PCT/US2013/029835 (13 pgs.).

(Continued)

*Primary Examiner* — Mark Rosenbaum

(74) *Attorney, Agent, or Firm* — Timothy S. Westby; Porter Hedges LLP

(57) ABSTRACT

Herein disclosed in a method comprising: shearing a feed comprising a solid component in a high shear device to produce a product, at least a portion of which comprises sheared solids; and separating at least some of the sheared solids from the product to produce a component-reduced product, wherein the solid component in the feed stream comprises a first particle density, and wherein the sheared solids in the product comprise a second particle density greater than the first particle density. In some embodiments, the solid component of the feed comprises gas trapped therein, and wherein at least a portion of said gas is released from the solid component upon shearing. Herein also is disclosed a method of comminuting solids in a feed stream comprising a solid component by processing the feed stream in a high shear device to produce a product stream comprising comminuted solids.

23 Claims, 4 Drawing Sheets

(56) References Cited

U.S. PATENT DOCUMENTS

| | | | | |
|---|---|---|---|---|
| 3,887,167 | A | 6/1975 | Irwin | |
| 4,882,035 | A | 11/1989 | Loutaty et al. | |
| 5,391,287 | A | 2/1995 | Nakagawa | |
| 5,538,191 | A | 7/1996 | Holl | |
| 5,877,350 | A | 3/1999 | Langer et al. | |
| 6,368,366 | B1 | 4/2002 | Langer et al. | |
| 6,368,367 | B1 | 4/2002 | Langer et al. | |
| 6,383,237 | B1 | 5/2002 | Langer et al. | |
| 6,530,964 | B2 | 3/2003 | Langer et al. | |
| 6,742,774 | B2 | 6/2004 | Holl | |
| 6,752,529 | B2 | 6/2004 | Holl | |
| 7,165,881 | B2 | 1/2007 | Holl | |
| 7,538,237 | B2 | 5/2009 | Holl | |
| 2002/0104799 | A1 | 8/2002 | Humphreys | |
| 2007/0209971 | A1 | 9/2007 | Duyvesteyn et al. | |
| 2010/0317748 | A1 * | 12/2010 | Hassan | B01F 7/00766 518/700 |

OTHER PUBLICATIONS

IKA-Rotor-Stator Generators—2003 Processing Ctalog (38 pgs.).
Gogate, et al. "Cavitation: A technology on the horizon," Current Science 91, No. 1, Jul. 2006, pp. 35-46 (12 pgs.).
Office Action dated Jun. 25, 2009 for U.S. Appl. No. 12/142,447 (10 pgs.).
Office Action dated Jan. 7, 2010 for U.S. Appl. No. 12/142,447 (6 pgs.).
Office Action dated May 13, 2010 for U.S. Appl. No. 12/142,447 (5 pgs.).
Office Action dated Feb. 4, 2010 for U.S. Appl. No. 12/492,721 (5 pgs.).
Office Action dated Feb. 18, 2010 for U.S. Appl. No. 12/635,433 (6 pgs.).
Office Action dated Feb. 18, 2010 for U.S. Appl. No. 12/635,454 (6 pgs.).
Office Action dated May 14, 2010 for U.S. Appl. No. 12/137,441 (15 pgs.).
Office Action dated Feb. 19, 2010 for U.S. Appl. No. 12/144,459 (10 pgs.).
Office Action dated Sep. 2, 2009 for U.S. Appl. No. 12/142,433 (11 pgs.).
Office Action dated Jan. 29, 2010 for U.S. Appl. No. 12/142,433 (8 pgs.).
Office Action dated May 24, 2011 for U.S. Appl. No. 12/142,433 (10 pgs.).
Office Action dated Apr. 30, 2010 for U.S. Appl. No. 12/141,191 (12 pgs.).
Office Action dated Oct. 27, 2009 for U.S. Appl. No. 12/142,120 (15 pgs.).
Office Action dated May 5, 2010 for U.S. Appl. No. 12/571,537 (12 pgs.).
Office Action dated Feb. 24, 2011 for U.S. Appl. No. 12/796,358 (13 pgs.).
Office Action dated Feb. 29, 2012 for U.S. Appl. No. 12/146,733 (8 pgs.).
Office Action dated Jun. 3, 2011 for U.S. Appl. No. 12/568,155 (11 pgs.).
Office Action dated Jun. 2, 2011 for U.S. Appl. No. 12/427,286 (12 pgs.).
Office Action dated Jun. 3, 2011 for U.S. Appl. No. 12/568,280 (16 pgs.).
IKA, "Introduction to IKA's Three Stage Dispax Reactor," Retrieved from <http://www.ikausa.com/pdfs/process/dr% 202000-Homogenizing-Dispersing-Suspending-Emulsifying,pdf> on Aug. 22, 2012 (12 pgs.).
IKA-DRS Reactors website http://www.ikausa.com/dr.him, on Sep. 8, 2010 (2 pgs.).
Chattopadhyay et al., "Understanding Mechanical Energy Driven Nonequilibrium Processing: Some Results, Eleventh International Conference on Rapidly Quenched and Metastable Materials," A Material Science and Engineering, vol. 375-377, dated Jul. 15, 2004, pp. 72-77 (9 pgs.).
International Preliminary Report on Patentability dated Aug. 6, 2015 for corresponding PCT Application PCT/US2013/029835; 10 pgs.

* cited by examiner

METHOD OF HIGH SHEAR COMMINUTION OF SOLIDS

CROSS-REFERENCE TO RELATED APPLICATIONS

This application claims benefit of U.S. Provisional Application Ser. No. 61/756,919 filed on Jan. 25, 2013, entitled "Method of High Shear Comminution of Solids" incorporated herein by reference in its entirety for all purposes.

STATEMENT REGARDING FEDERALLY SPONSORED RESEARCH OR DEVELOPMENT

Not Applicable.

BACKGROUND

1. Technical Field

Embodiments of the present disclosure relate to systems and methods for processing of hydrocarbon streams, such as heavy crude and/or bitumen, or process waste streams associated therewith. Yet other embodiments relate to comminuting solid particles in process streams, where comminution results in disintegrating the skeletal structure of the solid particles. Specific embodiments pertain to using a high shear device to comminute suspended solids in a process stream, where the solids have an initial internal porosity suitable for holding gas internally therein and a particle density, and wherein comminution of the solids moves the density toward skeletal density, releasing the trapped gas and reducing the internal porosity. Embodiments relate to the use of high shear in the separation of solids from feeds comprising bitumen and/or heavy crude oil, and the separation of water and mineral solids from tailings conventionally sent to a tailings pond. The separation may occur without the use of a gas or gas adjuvant.

2. Background of the Disclosure

Large deposits of heavy hydrocarbon sometimes referred to as bitumen are located in many countries around the world. Bitumen may be recoverable by means of secondary or tertiary recovery processes that involve heating, solubilization or mobility control. Many of these heavy hydrocarbon deposits contain high concentrations of asphaltenes that contribute to difficulties in recovery, transporting and upgrading. Oil sands, also, known as tar sands, are heavy hydrocarbons found in the United States, Canada, Russia, Venezuela, and various countries in the Middle East. Deposits in the oil sands of Alberta, Canada are the single-largest known source of petroleum in the world. These oil sands contain bitumen and as much as 17 wt % asphaltenes. The Orinoco oil belt in Venezuela is another large accumulation of bitumen. Additionally, heavy crudes produced all over the world typically contain some amount of asphaltenes.

Heavy crude oil or crude bitumen extracted from the earth is in a viscous, solid or semi-solid form that does not flow easily at normal oil pipeline temperatures, making it difficult to transport, and expensive to process into gasoline, diesel fuel, and other products. The economic recovery and utilization of heavy hydrocarbons, including bitumen, is a significant energy challenge. The demand for heavy crudes, such as those extracted from oil sands, has increased significantly due to dwindling reserves of conventional lighter crude. These heavy hydrocarbons, however, are typically located in geographical regions far removed from existing refineries. Consequently, the heavy hydrocarbons are often transported via pipelines to refineries. In order to transport heavy crudes in pipelines they must meet pipeline quality specifications.

Extraction techniques utilized to recover bitumen may be broken down into three major categories: (1) those which employ water, either hot or cold, to float the bitumen oils away from the tar sands, (2) those which employ an organic solvent to dissolve the bitumen oils, and (3) those that involve heat. Extraction of bitumen may be either by removing the deposits from the ground and extracting the bitumen externally or by in situ extraction, where only the bitumen is removed and the mineral components are left in the ground. Processes utilizing water often involve air floatation, and typically involve the utilization of an alkaline material. Due to the formation of stable emulsions containing fine tar sands ore particles, water and bitumen oils, water-based processes are not particularly efficient, especially on ore of lower bitumen content. The treatment of emulsions comprising large volumes of water, bitumen oils and fine tar sands ore particles has proven to be challenging.

Extraction of bitumen using heat can be done with electric, steam or other form of heaters as described, for example, in U.S. Pat. App. Nos. 2008/0135253 and 2009/0095480 by Vinegar et al. Various combinations of extraction techniques can be used to extract bitumen in situ. It is generally believed that in situ extraction will be more cost effective than surface mining, although the predominant method of bitumen extraction used today is surface mining. Another solvent extraction technique under development involves the utilization of solvents (in the absence of water) and is similar to techniques utilized in oil seed extraction processes. Percolation and immersion-type extractors have been used, but the need for special designs and scale-up for processing of abrasive tar sands make economical extraction difficult. For example, the solvent to bitumen ratio needed for efficient extraction is generally high, up to 10:1, producing concomitantly high capital and utilities costs for recovery of the solvent via, for example, distillation. For economy of solvent utilization, spent sands must be stripped of residual solvent prior to disposal. Stripping of residual solvent is a capital and energy intensive undertaking.

Existing solvent extraction methods for dissolving bitumen oils from tar sands, for example, as disclosed in U.S. Pat. No. 4,160,718 issued to Rendall, typically involve environmentally unacceptable losses of solvent and additional problems associated with the hazards posed by the necessary storage of large solvent inventories and the need for large quantities of water. Other solvent, hot water, and combination extraction processes are disclosed in U.S. Pat. No. 4,347,118 to Funk et al. and U.S. Pat. No. 3,925,189 to Wicks, III. These methods all have commercial and/or ecological drawbacks, rendering them undesirable. A method that utilizes both solvent and hot water for extraction of bitumen from tar sands is the subject of U.S. Pat. No. 4,424,112 to Rendall.

Bitumen extraction techniques that do not involve solvent conventionally utilize truck and shovel operations. In such operations, the oil sand is first mined and then is delivered to a crusher. In one such process, bitumen separation and recovery from the oil sand are accomplished by following what is known as the Clark hot water extraction process. In the front end of this process, crushed oil sand is mixed with hot water and caustic in a rotating tumbler or conditioned in a hydrotransport line to produce an aqueous slurry. In the tumbler or hydrotransport line, bitumen globules contact and coat air bubbles that are entrained in the slurry. The slurry is then screened to remove large rocks and the like. The screened slurry is diluted with additional water, and the product is then temporarily retained in a primary separation vessel (PSV). In the PSV, the buoyant, bitumen-coated air bubbles rise through the slurry and form bitumen froth. The sand in the slurry settles and is discharged from the base of the PSV, together with some water and bitumen. This stream or a portion thereof is referred to as the 'PSV underflow' or tailings. A 'middlings' portion comprising water, non-buoyant bitumen, and fines may be collected from the middle of the PSV. The froth overflows the lip of the PSV and is recovered as the primary froth, which typically comprises about 60 weight percent bitumen, about 30 weight percent water and about 10 weight percent particulate solids.

The PSV underflow is introduced into a deep cone vessel, referred to as the tailings oil recovery vessel ('TORV'). Here the PSV underflow is contacted and mixed with a stream of aerated middlings from the PSV. Again, bitumen and air bubbles contact and unite to form buoyant globules that rise and form froth. This 'secondary' froth overflows the lip of the TORV and is recovered. The secondary froth typically comprises about 45 weight percent bitumen, about 45 weight percent water and about 10 weight percent solids. The stream of middlings from the TORV is withdrawn and processed in a series of sub-aerated, impeller-agitated flotation cells. Secondary froth, typically comprising about 40 weight percent bitumen, about 50 weight percent water and about 10 weight percent solids, is produced from these cells.

The primary and secondary froth streams are typically combined to yield a product froth stream, often comprising about 60 weight percent bitumen, about 32 weight percent water and about 8 weight percent solids. The water and solids in the froth are contaminants which need to be reduced in concentration before the froth can be treated in a downstream refinery-type upgrading facility. This cleaning operation is generally carried out using what is referred to as 'froth treatment.'

While there are a variety of froth treatment processes, all of these processes include deaeration of the combined froth product, followed by dilution with sufficient solvent, typically naphtha, to provide a solvent to froth ('S/F') ratio of about 0.40 (w/w). This is done to increase the density differential between the diluted bitumen on the one hand and the water and solids on the other. By way of example, Kizior (U.S. Pat. No. 4,383,914), Guymon (U.S. Pat. No. 4,968,412), Shelfantook et al. (Canadian Pat. No. 1,293,465), Birkholz et al. (Canadian Pat. No. 2,232,929), Tipman et al. (Canadian Pat. No. 2,200,899), Tipman et al. (Canadian Pat. No. 2,353,109), Mishra et al. (U.S. Pat. No. 6,019,888), Cymerman et al. (U.S. Pat. No. 6,746,599), Beetge et al. (U.S. Pat. App. 20060196812, and Graham et al. (U.S. Pat. No. 5,143,598) describe ways of processing and treating the froth produced during the extraction process.

A serious problem, however, in using a solvent extraction process to remove bitumen from such a carbonaceous solid is that fines, primarily particles less than 50 microns in diameter, are carried over in the solvent-dissolved bitumen extract. Failure to remove the fines results in an undesirable high-ash bitumen product as well as problems with plugging of equipment used in the separation process, especially, for example, filtration equipment. Similar problems arise when other carbonaceous liquids besides bitumen, such as coal liquid or shale oil, are used. Removal of the fines during recovery of the bitumen, from a carbonaceous solid or from a previously recovered carbonaceous liquid, is therefore important in providing a desirable low-ash liquid product and in minimizing fouling and plugging of equipment used in the process. It would be highly desirable to develop an extraction method for recovering bitumen from the aforesaid carbonaceous solids, and for removing fines from the aforesaid carbonaceous liquids which would permit control of the solvency power of the extraction solvent so as to maximize the amount of bitumen or other carbonaceous liquid recovered, and to minimize the fines content therein.

Following extraction of bitumen, a diluent, such as light naphtha, is often added for transportation. The naphtha must be distilled and recycled, adding to energy costs. Changes in temperature and/or composition may cause the asphaltenes to fall out of solution, thus necessitating pipeline cleaning. Typically, removal of asphaltenes desirably removes some of the heavy metals and sulfur associated with crude oil. It is well known that asphaltenes can be separated from bitumen or asphaltenic crude oil by precipitation with paraffinic solvents such as pentane or heptanes (see, for example, U.S. Pat. App. 2006/0260980 to Yeung; U.S. Pat. App. 2008/0245705 to Siskin et al.; U.S. Pat. No. 5,326,456 to Brons et al.; U.S. Pat. No. 5,316,659 to Brons et al.; U.S. Pat. No. 4,699,709 to Peck et al.; and U.S. Pat. No. 4,596,651 to Wolff et al.). Additionally, various settling aids and/or flocculants have been utilized to enhance the separation of asphaltenes (see, for example, U.S. Pat. App. 2006/0196812 to Beetge et al.).

It is conventionally believed that a high solvent to oil ratio (e.g., on the order of 40:1 by volume) is required to separate substantially-pure asphaltenes from bitumen or asphaltic crude oil. At lower solvent levels, commonly used in solvent deasphalting, substantial non-asphaltenic material precipitates with the asphaltenes, resulting in undesirable oil losses. Furthermore, solvent deasphalting relies on multiple theoretical stages of separation of barely immiscible hydrocarbon liquids, and such stages are intolerant to the presence of water. The oil yield of solvent deasphalting is also limited by the high viscosity of the resultant asphaltic materials, particularly for high viscosity bitumen feeds. It is thus difficult to obtain high quality oil with high oil yield due to the difficulties in achieving clean separation of the oil and asphaltic fractions. In solvent deasphalting, asphalt (essentially asphaltenes with residual oil) is produced as a very viscous, hot liquid, which forms glassy solids when cooled. This viscous liquid must be heated to a high temperature in order to be transportable, causing fouling and plugging limitations.

Another technique for removal of asphaltenes involves breaking a froth of extra heavy oil and water with heat and a diluent solvent, such as naphtha. In the case of paraffinic naphtha, partial asphaltene removal results. However, only about 50% of the asphaltenes may be readily removed with this treatment even with multiple stages, and complete removal of asphaltenes is thus not practical. Therefore, the resulting oils must be further processed by utilizing capital intensive technology that is relatively tolerant to asphaltenes.

It is also typical for hydrocarbon streams, such as shale oil and bitumen streams, to have solids (e.g., solid particles, solid component, etc.) suspended therein that have huge internal porosity and a lot of internal gas. The particle density of such solids may be orders of magnitude greater than the skeletal density, making it difficult to fully separate and/or settle solids from the hydrocarbon stream.

Despite the development of the above mentioned froth and solvent extraction processes, there remains a need for improved systems and processes of extracting bitumen of higher quality, for example, containing less water, less solids, less asphaltenes and/or less diluent. It would be desirable if the enhanced systems and processes would allow increased bitumen recovery, for example, by reducing oil losses during asphaltene removal and/or reduced oil losses in the tailings. There is also a need in the art for a method of selectively and efficiently removing asphaltenic contaminants from heavy oil, which mitigates the above-mentioned difficulties of the prior art. It would be even further desirable if the systems and processes would allow bitumen extraction and/or asphaltene removal without requiring high solvent and/or water-to-bitumen ratios, long residence times, gas adjuvants, and/or numerous or expensive processing units. Such systems and processes should desirably facilitate recycle, and thus economy of utilization, of process water and/or conditioning agents, such as base (e.g., caustic) and/or bicarbonate. It would be desirable to be able to separate solids with large internal porosities from hydrocarbon streams in an economical and expedient manner.

SUMMARY

Herein disclosed in a method comprising: shearing a feed comprising a solid component in a high shear device to produce a product, at least a portion of which comprises sheared solids; and separating at least some of the sheared solids from the product to produce a component-reduced product, wherein the solid component in the feed stream comprises a first particle density, and wherein the sheared solids in the product comprise a second particle density greater than the first particle density.

In some embodiments, the solid component of the feed comprises gas trapped therein, and at least a portion of said gas is released from the solid component upon shearing. In some embodiments, the gas comprises carbon dioxide. In some embodiments, the feed comprises tailings from a caustic bitumen extraction process, and the component-reduced product comprises water having less than 10 wt % impurities. In some embodiments, at least a portion of the tailings is produced by mixing tar sand and water in a tumbler or a hydrotransport line to form a froth; introducing the froth into a separation cell; and removing the at least a portion of the tailings from the separation cell. In some embodiments, the feed comprises a liquid phase comprising tailings, asphaltenic oil, or a combination thereof, and the method further comprises shearing at a shear rate of at least 10,000 $s^{-1}$.

In some embodiments, separating at least some of the sheared solids from the product comprises separating the gas from the sheared solids in a settler. In some embodiments, the solid component comprises a first internal porosity greater than an internal porosity of the sheared solids. In some embodiments, the solid component is suspended in the feed, and the high shear device comminutes the solid component. In some embodiments, the feed comprises asphaltenic oil, and the component-reduced product comprises asphaltene-reduced oil. In some embodiments, the asphaltene-reduced oil comprises at least about 90 wt % bitumen. In some embodiments, the asphaltene-reduced oil comprises less than about 10 wt % asphaltenes. In some embodiments, the asphaltenic oil is selected from the group consisting of bitumen, heavy crude oils, and combinations thereof.

Herein also is disclosed a method of comminuting solids in a feed stream comprising a solid component, the method comprising: processing the feed stream in a high shear device to produce a product stream comprising comminuted solids; and separating at least some comminuted solids from the product stream to produce a component-reduced product stream, wherein the solid component in the feed stream comprises a first particle density and comprises gas trapped therein, and wherein gas is released from the solid component after processing.

In some embodiments, the comminuted solids in the product stream comprise a second particle density greater than the first particle density. In some embodiments, the gas comprises carbon dioxide, the feed stream comprises tailings from a caustic bitumen extraction process, and the component-reduced product comprises water having less than 10 wt % impurities. In some embodiments, at least a portion of the tailings are produced by: mixing tar sand and water in a tumbler or a hydrotransport line to form a froth, introducing the froth into a separation cell; and removing the at least a portion of the tailings from the separation cell. In some embodiments, the solid component comprises particles having tar and gas inside, and tar and gas are released from the particles by comminuting a skeletal structure of the particles. In some embodiments, the feed stream comprises shale oil, the solid component comprises trapped gas, trapped gas is released from the solid component by comminuting a skeletal structure of the solid component, and the comminuted solids have a second density greater than the first density. In some embodiments, the component-reduced product stream comprises at least some of the released gas, and at least a portion of the released gas is removed from the component-reduced product stream in a settler.

These and other embodiments and potential advantages will be apparent in the following detailed description and drawings.

BRIEF DESCRIPTION OF THE DRAWINGS

For a more detailed description of the preferred embodiment of the present disclosure, reference will now be made to the accompanying drawings, wherein.

NOTATION AND NOMENCLATURE

As used herein, the phrase 'asphaltenic oil' refers to any oil containing at least some percentage of asphaltenes. The 'asphaltenic oil' may be, for example, bitumen comprising asphaltenes, heavy crude oil comprising asphaltenes, and the like.

As used herein, the term 'dispersion' refers to a liquefied mixture that contains at least two distinguishable substances (or 'phases'). As used herein, a 'dispersion' comprises a 'continuous' phase (or 'matrix'), which holds therein discontinuous droplets, bubbles, and/or particles of the other phase or substance. The term dispersion may thus refer to foams comprising gas bubbles suspended in a liquid continuous phase, emulsions in which droplets of a first liquid are dispersed throughout a continuous phase comprising a second liquid with which the first liquid is immiscible, and continuous liquid phases throughout which solid particles are distributed. As used herein, the term "dispersion" encompasses continuous liquid phases throughout which gas bubbles are distributed, continuous liquid phases throughout which solid particles are distributed, continuous phases of a first liquid throughout which droplets of a second liquid that is substantially insoluble in the continuous phase are distributed, and liquid phases throughout which any one or a combination of solid particles, immiscible liquid droplets, and gas bubbles is distributed. Hence, a dispersion can exist as a homogeneous mixture in some cases (e.g., liquid/liquid phase), or as a heterogeneous mixture (e.g., gas/liquid, solid/liquid, or gas/solid/liquid), depending on the nature of the materials selected for combination. A dispersion may comprise, for example, bubbles of gas (e.g. carbon dioxide) in a liquid (e.g. stream comprising tailings, bitumen and/or heavy crude oil) and/or droplets of one fluid in a phase with which it is immiscible.

Figure 6:
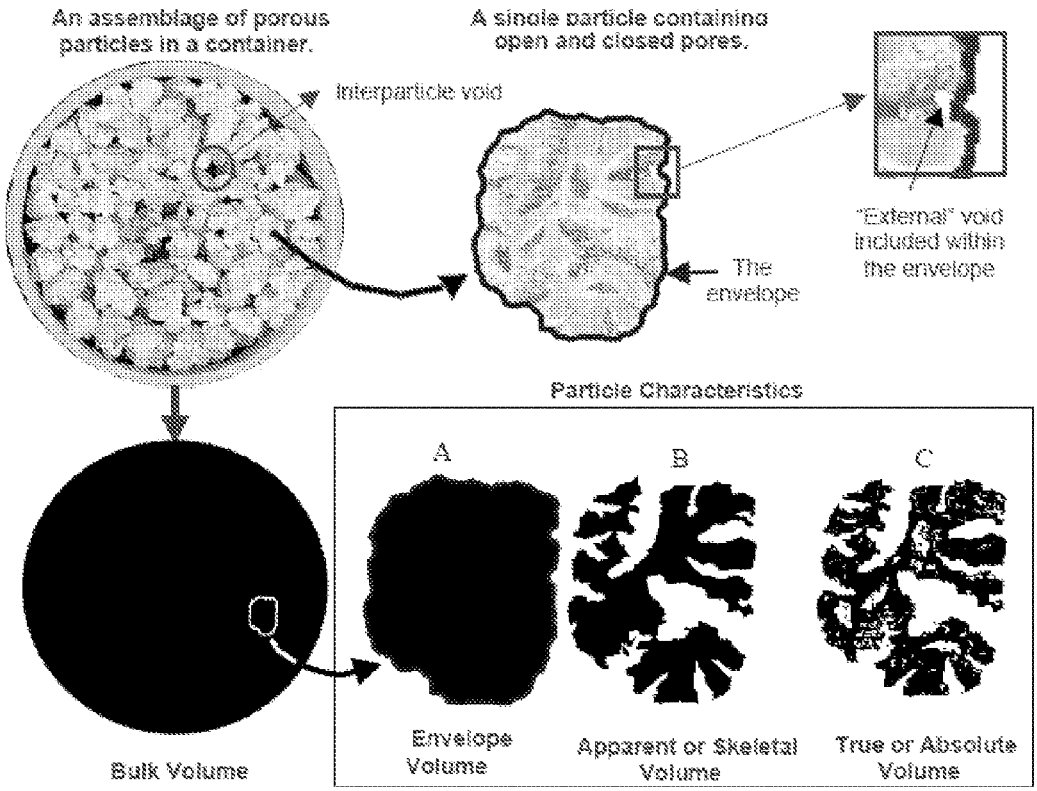
FIG. 6 is an illustrative example of bulk volume compared to apparent volume.

The solid material described herein may include materials that contain various types of elemental volumes that may differ in material volume depending upon measurement technique, method, and conditions under which the measurements are performed. For example, a solid may have surface irregularities, small fractures, fissures, and pores that both communicate with the surface and that are isolated within the structure. Voids that connect to the surface are referred to as open pores, whereas interior voids inaccessible from the surface are called closed or blind pores. FIG. 6 illustrates an example of the disparity between bulk volume as compared to apparent volume that accounts for voids and irregularities.

When a solid material is in granular or powdered form, the bulk contains another type of void: interparticle space. The total volume of interparticle voids depends on the size and shape of the individual particles and how well the particles are packed. Skeletal volume may refer to the sum of the volumes of the solid particle or material and closed (or blind) pores within the pieces (Implied by ASTM D3766). For compressible fluids (i.e. gases), voids are also a function of temperature and pressure.

With regard to density, effective particle density may be the mass of a particle divided by the volume thereof, including open pores and closed pores (BSI). Skeletal density may be the ratio of the mass of discrete pieces of solid particle to the sum of the volumes of the solid particle and closed (or blind) pores within the particle (ASTM D3766).

Effective porosity may be a ratio, usually expressed as a percentage of the total volume of voids available for fluid transmission to the total volume of the porous medium, porosity being the interparticle void space between particles, and particle porosity being the ratio of the volume of open pore to the total volume of the particle Use of the phrase, 'all or a portion of' is used herein to mean 'all or a percentage of the whole' or 'all or some components of.'

DETAILED DESCRIPTION

Overview. Herein disclosed are systems and methods of removing a solid component from a stream produced during recovery and/or processing of heavy crude oil or bitumen (e.g., from tar sands). The system and method are utilized, in embodiments, to precipitate asphaltenes from bitumen and/or heavy crude oil. In embodiments, the system and method are suitable for facilitating recovery of water from slurries (comprising sediments/sand particles) that are conventionally introduced into tailings ponds or recycled back to the process. The system comprises an external high shear mechanical device to provide rapid contact and mixing of reactants in a controlled environment in the reactor/mixer device. In embodiments, the system and method allow removal of asphaltenes at lower temperatures and/or pressures than conventional methods and/or more rapid and/or more complete removal of asphaltenes. In embodiments, the system and method allow extraction of bitumen from tar sands with utilization of less water than conventional systems and methods by facilitating removal of water from a stream produced during extraction, and recycle of removed water for further extraction. A reactor assembly that comprises an external high shear device (HSD) or mixer as described herein may decrease mass transfer limitations and thereby allow faster precipitation and/or removal of a desired component, such as, without limitation, precipitation and removal of asphaltenes from oil, removal of solids from tailings, and removal of water from tailings.

System for Removal of a Component from a Stream Produced During Recovery and/or Processing of Heavy Crude Oil or Bitumen. Herein disclosed is a system for removal of a solid component from a stream produced during recovery and/or processing of heavy crude oil and/or bitumen. In embodiments, the system is utilized for removal of asphaltenes from asphaltenic heavy crude oil and/or bitumen. In embodiments, the system is utilized to enhance extraction of bitumen from tar sand, and reduce water usage during extraction.

Figure 1:
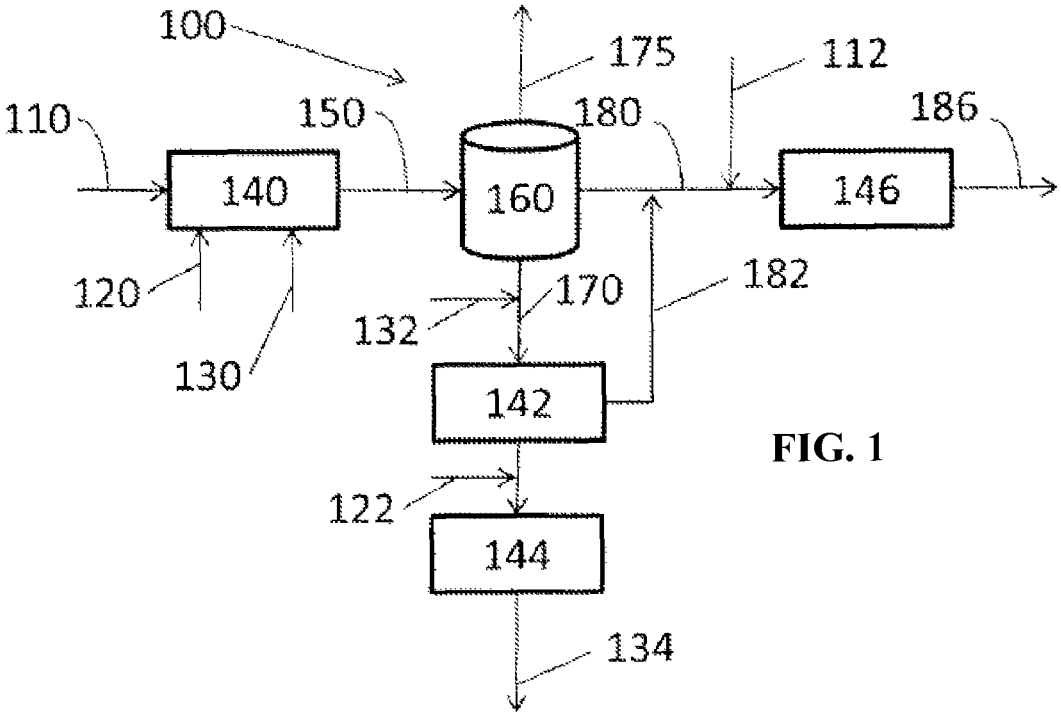
FIG. 1 is a schematic of a high shear system comprising an external high shear mixer/disperser according to an embodiment of the present disclosure.

FIG. 1 is a schematic of a high shear system 100 according to an embodiment of this disclosure. System 100 comprises high shear device 140 and centrifuge 160. In certain embodiments, additional high shear devices 142, 144, 146 may be provided to further process selected streams of material. Although described herein as a centrifuge, it is to be understood that unit 160 may be any gravimetric or density based separation device known to those experienced in the art.

Figure 2:
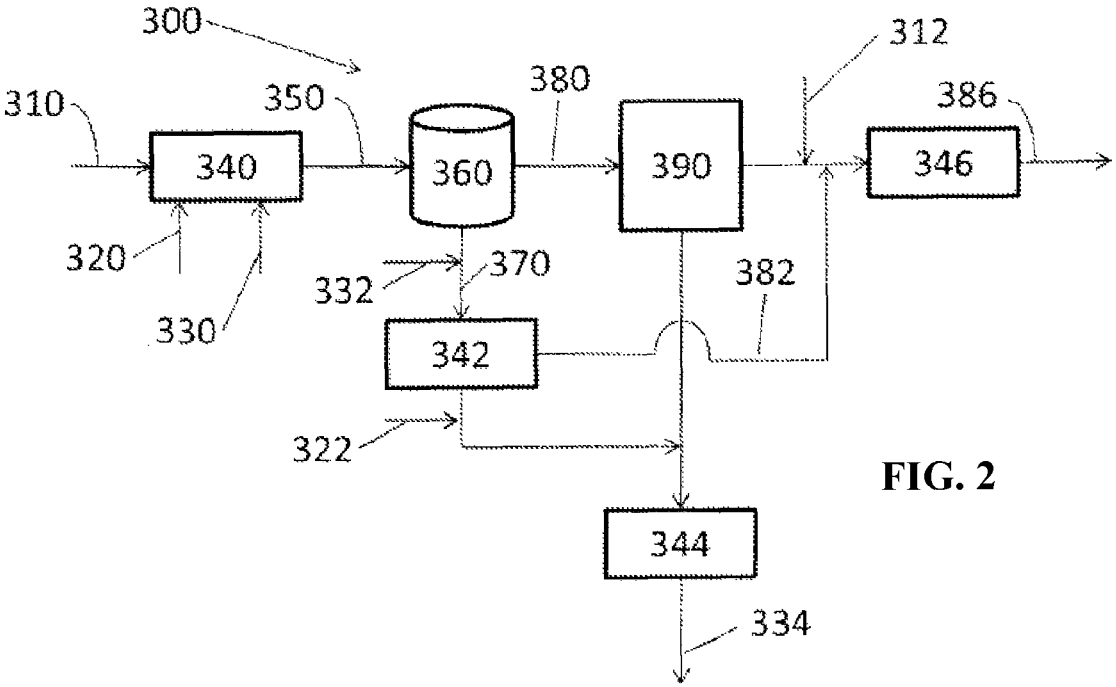
FIG. 2 is a schematic of a high shear system comprising an external high shear mixer/disperser according to another embodiment of the present disclosure.

FIG. 2 is a schematic of a high shear system 300 according to another embodiment of this disclosure. High shear system 300 comprises a high shear device 340 along with a centrifuge 360 and a settling tank 390. In certain embodiments, additional high shear devices 342, 344, 346 may be provided to further process portions of the material in inlet line 310. Each of these components of high shear systems 100/300 is described in more detail hereinbelow. One or more inlet lines 110, 310 are connected to the HSD 140, 340 for introducing a feed mixture thereto. The feed mixture may be a bitumen/water mix that may be introduced directly to the HSD 140, 340 from a tumbler extraction unit, where the bitumen is initially separated from the sand. As pure bitumen is rather thick and not readily pumpable, diluents might be added at any stage. Additionally, in order to avoid having to dilute the bitumen, following separation of the sand, the extracted water/bitumen mix (dilute bitumen) can be subjected to shear and the asphaltene dropped out. The bitumen/water mix may be heated as desired during processing.

As mentioned hereinabove, the high shear system may further comprise a feed source. For example, bitumen or heavy crude for introduction into HSD 140, 340 via line 110, 310 may be produced using apparatus known in the art, and discussed further below with respect to FIG. 3. Feed introduced into HSD 140, 340 via feed line 110, 310 may comprise tailings conventionally introduced into a tailings pond or recycled. The tailings may be produced using any means known in the art, and high shear system 100, 300 may comprise apparatus for the production of such tailings. In other embodiments, the tailings are produced utilizing any combination of the apparatus disclosed in U.S. Pat. No. 5,626,743. In embodiments, the disclosed system obviates the need for a conventional tailings pond, and the use of the term tailings is meant to indicate those streams conventionally introduced into a tailings pond but does not require that the tailings come from a tailings pond, per se.

In the embodiment of FIG. 1, inlet line 110 is fluidly connected with HSD 140 for the introduction of feed comprising bitumen, heavy crude or other streams that may be conventionally sent to a tailings pond. In certain embodiments, carbon dioxide inlet line 120 and water inlet line 130 are fluidly connected with HSD 140 to supply carbon dioxide and/or water, respectively, to HSD 140. In alternative embodiments, a single inlet line is fluidly connected with the HSD and the feed (e.g., tailings, bitumen, and/or heavy crude oil), and optionally additional carbon dioxide and/or water are combined prior to introduction into the HSD. Water and/or carbon dioxide, either heated or at ambient conditions, can be added at any point in the process to aid in flow, to aid in the formation of carbonic acid, and/or to aid in the separation of unwanted elements from the product oil (e.g., bitumen).

Flow line 150 carries a high shear-treated stream out of HSD 140. The composition of the feed stream may include various solids, which may have a particular volume and density. In accordance with embodiments of the disclosure, feed streams may be processed in a high shear device to produce a product stream comprising sheared solids. The feed stream may initially contain a solid particle component with a first particle density, while sheared solids in a shear product stream have a second (post-processing) particle density that is greater than the first particle density. Without wishing to be limited by theory, this is believed to be attributable to the solid particle having a skeletal structure that traps gas inside the particle, where upon processing the skeletal structure is physically altered and the gas may be released. As a result of released gas, the effective particle density is increased.

Centrifuge 160 is fluidly connected to HSD 140 via high shear-treated product flow line 150. Centrifuge 160 may comprise one or more outlet lines. For example, in the embodiment of FIG. 1, centrifuge 160 comprises heavy component outlet line 170 and component-reduced (e.g., asphaltene-reduced) product outlet line 180. A gas outlet line 175 may be fluidly connected with the centrifuge for removal of product gas. A recycle line (not shown) may fluidly connect the gas outlet line with other unit operations in the system.

Heavy component outlet line 170 may be fluidly connected to a secondary HSD 142 that further processes, or shears, the heavy components recovered from the centrifuge 160. The supply of material to the secondary HSD 142 may be augmented by inlet line 132 that may optionally supply water, emulsifiers, carbon dioxide, and/or other materials to the heavy component outlet line 170 prior to processing by the secondary HSD 142. The secondary HSD 142 mixes the heavy components from centrifuge 160 with the liquids and/or gases from inlet line 132, so as to facilitate further separation of desirable materials, such as hydrocarbons, from the processed stream.

Line 182 fluidly couples the secondary HSD 142 to product outlet line 180 to allow hydrocarbons recovered after processing, or shearing, by the secondary HSD 142 to be mixed with the component-reduced outlet from HSD 140. In certain embodiments, secondary supply line 112 may also, or alternatively, provide for the addition of additional hydrocarbons, or other materials into product outlet line 180. This combined stream from product outlet line 180, recovered hydrocarbon line 182, and secondary supply line 112 is processed by mixing HSD 146. Mixing HSD 146 includes an outlet line 186 for supplying the mixed components to a refinery, pipeline, or other downstream application.

The remainder of the material from the secondary HSD 142 is mixed with a supply of gas, such as air, via supply line 122 and supplied to a treatment HSD 144. The gas from supply line 122 is mixed into the products stream by the treatment HSD 144 to facilitate the treatment and cleaning of the remaining product, which may include a substantial quantity of water. Treatment HSD 144 may provide rapid contact and mixing of gas via supply line 122 and the remaining product, and reduce mass transfer limitations on the desired reactions/interactions. This may reduce the time required for treatment of the remaining product. The use of treatment HSD 144 may also allow for the use of decreased amounts of gas (e.g. air, chlorine) and/or liquid (e.g. liquid flocculating agents) treatment aids than conventional water treatment processes.

The high shear system may be used to form a dispersion of a treatment gas in a liquid, for example, a dispersion of oxygen, air, and/or chlorine in the water to be treated. Such a dispersion may enhance the amount of dissolved gas, due to the reduced diameter of the bubbles in the dispersion, which typically have a mean bubble diameter of less than about 5 μm. Although not discussed in detail herein, the high shear system may also be used to intimately mix two liquid streams, for example, a water stream to be treated and a liquid flocculating agent. In these embodiments, the high shear device may increase the flocculation of contaminants by effecting intimate mixing within interaction zone(s). Further description of the treatment of water using high shear devices is provided in U.S. Pat. No. 7,842,184 and U.S. Published Patent Application No. 2011/0266198, both of which are hereby incorporated herein by reference for all purposes not contrary to this disclosure.

Referring now to FIG. 2, inlet line 310 is fluidly connected with HSD 340 for the introduction of feed comprising bitumen, heavy crude or other streams that may be conventionally sent to a tailings pond. In certain embodiments, carbon dioxide inlet line 320 and water inlet line 330 are fluidly connected with HSD 340 to supply carbon dioxide and/or water, respectively, to the HSD 340. In alternative embodiments, a single inlet line is fluidly connected with the HSD and the feed (e.g., tailings, bitumen, and/or heavy crude oil), and optionally additional carbon dioxide and/or water are combined prior to introduction into the HSD. Water and/or carbon dioxide, either heated or at ambient conditions, can be added at any point in the process to aid in flow, to aid in the formation of carbonic acid, and/or to aid in the separation of unwanted elements from the product oil (e.g., bitumen).

Flow line 350 carries a high shear-treated stream out of HSD 340. The composition of the feed stream may include various solids, which may have a particular volume and density. In accordance with embodiments of the disclosure, feed streams may be processed in a high shear device to produce a product stream comprising sheared solids. The feed stream may initially contain a solid particle component with a first particle density, while sheared solids in a shear product stream (i.e. post processing) have a second particle density that is greater than the first particle density. Without wishing to be limited by theory, this is believed to be attributable to the solid particle having a skeletal structure that traps gas inside the particle, where upon processing the skeletal structure is physically altered and the gas may be released. As a result of released gas, the effective particle density is increased.

Centrifuge 360 is fluidly connected to HSD 340 via high shear-treated product flow line 350. Centrifuge 360 may comprise one or more outlet lines. For example, in the embodiment of FIG. 2, centrifuge 360 comprises heavy component outlet line 370 and component-reduced (e.g., asphaltene-reduced) product outlet line 380. Product outlet line 380 supplies a component-reduced product to a separation apparatus 390 adapted for separation of a water phase from an oil phase. Separation apparatus 390 may comprise a settling tank. Component-reduced product outlet line 380 fluidly connects centrifuge 360 with separation apparatus 390. Separation apparatus 390 is configured to provide adequate residence time for separation of an oil phase comprising oil (e.g., bitumen) from an aqueous phase. The aqueous phase may comprise bicarbonate.

Heavy component outlet line 370 may be fluidly connected to a secondary HSD 342 that further processes the heavy components recovered from the centrifuge 360. The supply of material to the secondary HSD 342 may be augmented by inlet line 332 that may optionally supply water, emulsifiers, carbon dioxide, and/or other materials to the heavy component outlet line 370 prior to processing by the secondary HSD 342.

The secondary HSD 342 acts to further separate desirable materials, such as hydrocarbons, from the processed stream by comminution of solid particles within the processed stream. Line 382 fluidly couples the secondary HSD 342 to product outlet line 380 to allow hydrocarbons recovered by the secondary HSD 342 to be mixed with the component-reduced outlet from HSD 340. In certain embodiments, secondary supply line 312 may also, or alternatively, provide for the addition of additional hydrocarbons, or other materials into product outlet line 380. This combined stream from product outlet line 380, recovered hydrocarbon line 382, and secondary supply line 312 is processed by mixing HSD 346. Mixing HSD 346 includes an outlet line 386 for supplying the mixed components to a refinery, pipeline, or other downstream application.

The remainder of the material from the secondary HSD 342 is mixed with a supply of gas, such as air, via supply line 322 and supplied to a treatment HSD 344. The gas from supply line 322 is mixed into the products stream by the treatment HSD 344 to facilitate the treatment and cleaning of the remaining product, which may include a substantial quantity of water. Treatment HSD 344 may provide rapid contact and mixing of gas via supply line 322 and the remaining product, and reduce mass transfer limitations on the desired reactions/interactions. This may reduce the time required for treatment of the remaining product. The use of treatment HSD 344 may also allow for the use of decreased amounts of gas (e.g. air, chlorine) and/or liquid (e.g. liquid flocculating agents) treatment aids than conventional water treatment processes.

The high shear system may be used to form a dispersion of a treatment gas in a liquid, for example, a dispersion of oxygen, air, and/or chlorine in the water to be treated. Such a dispersion may enhance the amount of dissolved gas, due to the reduced diameter of the bubbles in the dispersion, which typically have a mean bubble diameter of less than about 5 μm. Although not discussed in detail herein, the high shear system may also be used to intimately mix two liquid streams, for example, a water stream to be treated and a liquid flocculating agent. In these embodiments, the high shear device may increase the flocculation of contaminants by effecting intimate mixing within interaction zone(s). Further description of the treatment of water using high shear devices is provided in U.S. Pat. No. 7,842,184 and U.S. Published Patent Application No. 2011/0266198, both of which are hereby incorporated herein by reference for all purposes not contrary to this disclosure.

Figure 3:
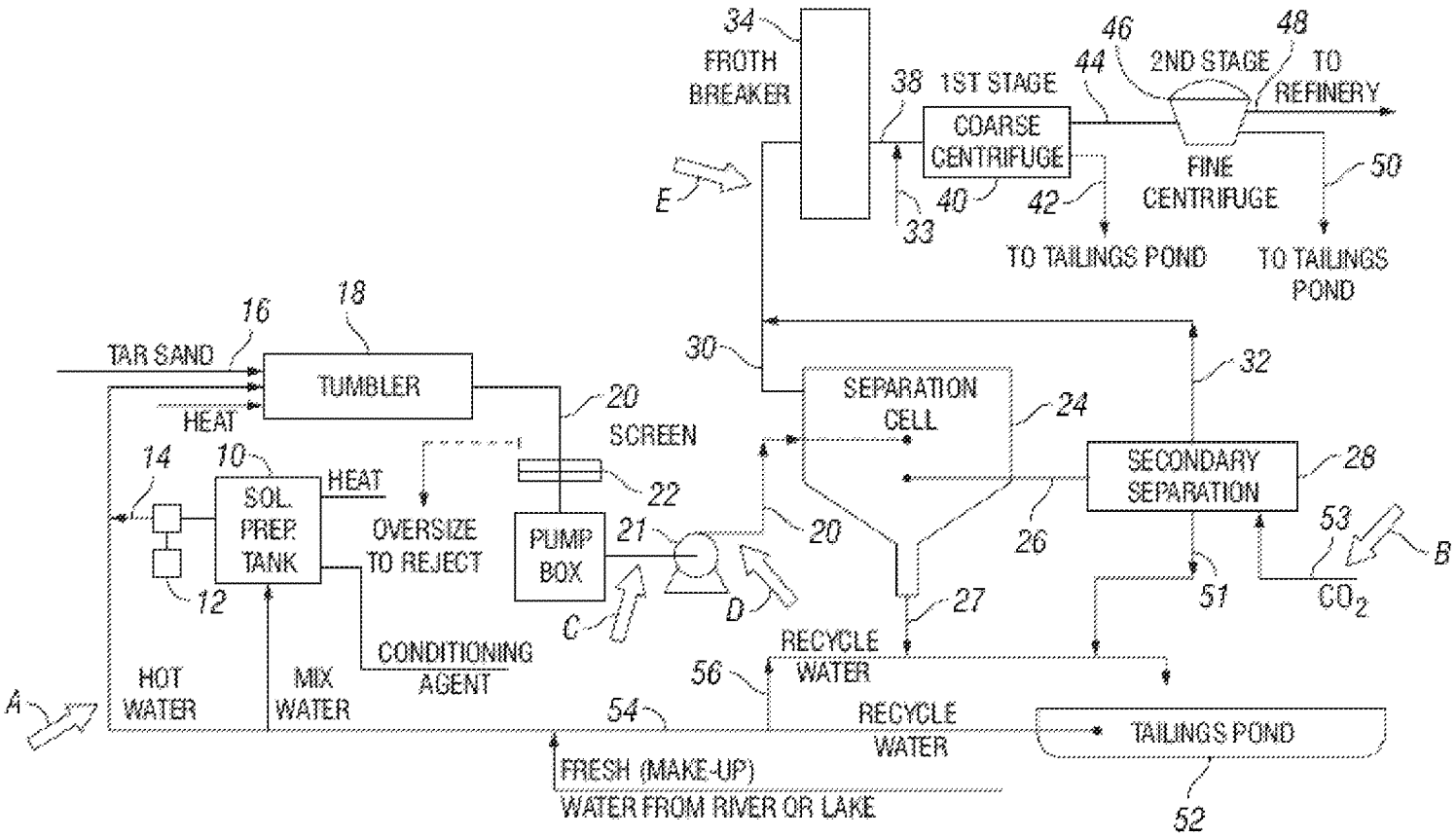
FIG. 3 (Prior Art)
FIG. 3 is a schematic flow diagram of a prior art hot water extraction process suitable for incorporation, as indicated, for example, by arrows A-E, of one or more high shear devices according to this disclosure.

As previously discussed, high shear systems 100, 300 are suited for the processing of bitumen, and other heavy hydrocarbons, such as those recovered from tar sands. Suitable systems for extraction of bitumen from tar sands include hot water extraction systems, for example, as disclosed in U.S. Pat. No. 5,626,743. FIG. 3 is a prior art system for hot water extraction of bitumen from tar sands, as described in U.S. Pat. No. 5,626,743. High shear system 100, 300 may thus be incorporated into an existing system for extraction of bitumen from tar sands or may be incorporated into a system for the processing of heavy crude oil. In embodiments, high shear system 100, 300 further comprises a combination of the apparatus indicated in FIG. 4, whereby the feed to the system is obtained. Thus, in embodiments, high shear system 100/300 further comprises one or more tumblers 18, one or more transport pipes adapted for transport of feed whereby bitumen froth is formed, one or more separation cells 24, one or more tailings ponds 52, one or more secondary separation units 28, or some combination thereof.

Additional components or process steps can be incorporated between HSD 140/340 and centrifuge 160/360 or ahead of HSD 140/340, if desired, as will become apparent upon reading the description of the high shear process hereinbelow.

High Shear Devices. The high shear systems 100/300 each comprise at least one HSD. An HSD, also sometimes referred to as a high shear mixer, is configured for receiving one or more feed streams and processing those streams via a high shear mechanism. Although only one HSD is shown for processing the feed mixture in the embodiments of FIGS. 1 and 2, it should be understood that some embodiments of the system can comprise two or more HSDs for processing the feed, as discussed hereinabove. The two or more HSDs can be arranged in series flow, in parallel flow, or a combination thereof.

An HSD is a mechanical device that utilizes one or more generators comprising a rotor/stator combination, each of which has a gap between the stator and rotor. The gap between the rotor and the stator in each generator set may be fixed or may be adjustable. The HSD is configured in such a way that it is capable of effectively contacting the components therein at rotational velocity. The HSD comprises an enclosure or housing so that the pressure and temperature of the fluid therein may be controlled.

High shear devices are generally divided into three general classes, based upon their ability to mix fluids. One metric for the degree or thoroughness of operation is the energy density per unit volume that the device generates to disrupt the fluid particles. The classes are distinguished based on delivered energy densities. Three classes of industrial shear mixers having sufficient energy density to consistently produce mixtures or emulsions with particle sizes in the range of submicron to 50 microns are homogenization valve systems, colloid mills and high speed mixers. In the first class of high energy devices, referred to as homogenization valve systems, fluid to be processed is pumped under very high pressure through a narrow-gap valve into a lower pressure environment. The pressure gradients across the valve, and the resulting turbulence and cavitation act to break-up particles in the fluid. These valve systems are most commonly utilized in milk homogenization, and can yield average particle sizes in the submicron to about 1 micron range.

At the opposite end of the energy density spectrum is the third class of devices referred to as low energy devices. These systems typically employ paddles or fluid rotors that turn at high speed in a reservoir of fluid to be processed, which in many of the more common applications is a food product. These low energy systems are customarily used when average particle sizes of greater than 20 microns are acceptable in the processed fluid.

Between the low energy devices and homogenization valve systems, in terms of the mixing energy density delivered to the fluid, are colloid mills and other high speed rotor-stator devices, which are classified as intermediate energy devices. A typical colloid mill configuration includes a conical or disk rotor that is separated from a complementary, liquid-cooled stator by a closely-controlled rotor-stator gap, which is commonly between 0.025 mm to 10 mm (0.001-0.40 inch). Rotors are usually driven by an electric motor through a direct drive or belt mechanism. As the rotor rotates at high rates, it pumps fluid between the outer surface of the rotor and the inner surface of the stator, and shear forces generated in the gap process the fluid. Many colloid mills with proper adjustment achieve average particle sizes of 0.1 to 25 microns in the processed fluid. These capabilities render colloid mills appropriate for a variety of applications, including colloid and oil/water-based emulsion processing such as that required for cosmetics, mayonnaise, and silicone/silver amalgam formation, to roofing-tar mixing.

The HSDs of the present disclosure may include at least one revolving element that creates the mechanical force applied to the reactants therein. Each HSD comprises at least one stator and at least one rotor separated by a clearance. For example, the rotors can be conical or disk shaped and can be separated from a complementarily-shaped stator. In embodiments, both the rotor and the stator comprise a plurality of circumferentially-spaced rings having complementarily-shaped tips. A ring may comprise a solitary surface or tip encircling the rotor or the stator. In embodiments, both the rotor and stator comprise more than 2 circumferentially-spaced rings, more than 3 rings, or more than 4 rings. For example, in embodiments, each of three generators comprises a rotor and stator each having 3 complementary rings, whereby the material processed passes through 9 shear gaps or stages upon traversing the HSD. Alternatively, each of three generators may comprise four rings, whereby the processed material passes through 12 shear gaps or stages upon passing through the HSD. In some embodiments, the stator(s) are adjustable to obtain the desired shear gap between the rotor and the stator of each generator (rotor/stator set). Each generator may be driven by any suitable drive system configured for providing the desired rotation.

In some embodiments, an HSD comprises a single stage dispersing chamber (i.e., a single rotor/stator combination; a single high shear generator). In some embodiments, an HSD is a multiple stage inline disperser and comprises a plurality of generators. In certain embodiments, an HSD comprises at least two generators. In other embodiments, an HSD comprises at least 3 generators. In some embodiments, an HSD is a multistage device whereby the shear rate (which varies proportionately with tip speed and inversely with rotor/stator gap width) varies with longitudinal position along the flow pathway, as further described hereinbelow.

According to this disclosure, at least one surface within an HSD may be made of, impregnated with, or coated with a catalyst that is suitable for assisting the desired component extraction, for example converting caustic soda to sodium bicarbonate. Further description is provided in U.S. patent application Ser. No. 12/476,415, which is hereby incorporated herein by reference for all purposes not contrary to this disclosure.

In some embodiments, the minimum clearance (shear gap width) between the stator and the rotor is in the range of from about 0.025 mm (0.001 inch) to about 3 mm (0.125 inch). The shear gap may be in the range of from about 5 micrometers (0.0002 inch) and about 4 mm (0.016 inch). In embodiments, the shear gap is in the range of 5, 4, 3, 2 or 1 μm. In some embodiments, the minimum clearance (shear gap width) between the stator and the rotor is in the range of from about 1 μm (0.00004 inch) to about 3 mm (0.012 inch). In some embodiments, the minimum clearance (shear gap width) between the stator and the rotor is less than about 10 μm (0.0004 inch), less than about 50 μm (0.002 inch), less than about 100 μm (0.004 inch), less than about 200 μm (0.008 inch), less than about 400 μm (0.016 inch). In certain embodiments, the minimum clearance (shear gap width) between the stator and rotor is about 1.5 mm (0.06 inch). In certain embodiments, the minimum clearance (shear gap width) between the stator and rotor is about 0.2 mm (0.008 inch). In certain configurations, the minimum clearance (shear gap) between the rotor and stator is at least 1.7 mm (0.07 inch). The shear rate produced by the HSD may vary with longitudinal position along the flow pathway. In some embodiments, the rotor is set to rotate at a speed commensurate with the diameter of the rotor and the desired tip speed. In some embodiments, an HSD has a fixed clearance (shear gap width) between the stator and rotor. Alternatively, an HSD has adjustable clearance (shear gap width).

Tip speed is the circumferential distance traveled by the tip of the rotor per unit of time. Tip speed is thus a function of the rotor diameter and the rotational frequency. Tip speed (in meters per minute, for example) may be calculated by multiplying the circumferential distance transcribed by the rotor tip, $2\pi R$, where R is the radius of the rotor (meters, for example) times the frequency of revolution (for example revolutions per minute, rpm). The frequency of revolution may be greater than 250 rpm, greater than 500 rpm, greater than 1000 rpm, greater than 5000 rpm, greater than 7500 rpm, greater than 10,000 rpm, greater than 13,000 rpm, or greater than 15,000 rpm. The rotational frequency, flow rate, and temperature may be adjusted to get a desired product profile. If channeling should occur, and reaction is inadequate, the rotational frequency may be increased to minimize undesirable channeling. Alternatively or additionally, high shear-treated product may be introduced into a second or subsequent HSD.

An HSD may provide a tip speed in excess of 22.9 m/s (4500 ft/min) and may exceed 40 m/s (7900 ft/min), 50 m/s (9800 ft/min), 100 m/s (19,600 ft/min), 150 m/s (29,500 ft/min), 200 m/s (39,300 ft/min), or even 225 m/s (44,300 ft/min) or greater in certain applications. For the purpose of this disclosure, the term 'high shear' refers to mechanical rotor stator devices (e.g., colloid mills or rotor-stator dispersers) that are capable of tip speeds in excess of 5.1 m/s (1000 ft/min) or those values provided above and require an external mechanically driven power device to drive energy into the stream of products to be reacted. By contacting the reactants with the rotating members, which can be made from, coated with, or impregnated with stationary catalyst, significant energy is transferred to the reaction. The energy consumption of an HSD will generally be very low.

In some embodiments, an HSD is capable of delivering at least 300 L/h at a tip speed of at least 22.9 m/s (4500 ft/min). The power consumption may be about 1.5 kW. An HSD combines high tip speed with a very small shear gap to produce significant shear on the material being processed. The amount of shear will be dependent on the viscosity of the fluid in the HSD. Accordingly, a local region of elevated pressure and temperature is created at the tip of the rotor during operation of a HSD. In some cases the locally elevated pressure is about 1034.2 MPa (150,000 psi). In some cases the locally elevated temperature is about 500° C. In some cases, these local pressure and temperature elevations may persist for nano- or pico-seconds.

An approximation of energy input into the fluid (kW/L/min) can be estimated by measuring the motor energy (kW) and fluid output (L/min). As mentioned above, tip speed is the velocity (ft/min or m/s) associated with the end of the one or more revolving elements that is creating the mechanical force applied to the fluid. In embodiments, the energy expenditure is at least about 1000 W/m$^3$, 5000 W/m$^3$, 7500 W/m$^3$, 1 kW/m$^3$, 500 kW/m$^3$, 1000 kW/m$^3$, 5000 kW/m$^3$, 7500 kW/m$^3$, or greater. In embodiments, the energy expenditure of HSD 140/340 is greater than 1000 watts per cubic meter of fluid therein. In embodiments, the energy expenditure of HSD 140/340 is in the range of from about 3000 W/m$^3$ to about 7500 kW/m$^3$. In embodiments, the energy expenditure of HSD 140/340 is in the range of from about 3000 W/m$^3$ to about 7500 W/m$^3$. The actual energy input needed is a function of what reactions are occurring within the HSD, for example, endothermic and/or exothermic reaction(s), as well as the mechanical energy required for dispersing and mixing feedstock materials. In some applications, the degree of exothermic reaction(s) occurring within an HSD mitigates some or substantially all of the reaction energy needed from the motor input.

The shear rate is the tip speed divided by the shear gap width (minimal clearance between the rotor and stator). The shear rate generated in an HSD may be greater than 20,000 s$^{-1}$. In some embodiments the shear rate is at least 30,000 s$^{-1}$ or at least 40,000 s$^{-1}$. In some embodiments the shear rate is greater than 30,000 s$^{-1}$. In some embodiments the shear rate is at least 100,000 s$^{-1}$. In some embodiments the shear rate is at least 500,000 s$^{-1}$. In some embodiments the shear rate is at least 1,000,000 s$^{-1}$. In some embodiments the shear rate is at least 1,600,000 s$^{-1}$. In some embodiments the shear rate is at least 3,000,000 s$^{-1}$. In some embodiments the shear rate is at least 5,000,000 s$^{-1}$. In some embodiments the shear rate is at least 7,000,000 s$^{-1}$. In some embodiments the shear rate is at least 9,000,000 s$^{-1}$. In embodiments where the rotor has a larger diameter, the shear rate may exceed about 9,000,000 s$^{-1}$. In embodiments, the shear rate generated by an HSD is in the range of from 20,000 s$^{-1}$ to 10,000,000 s$^{-1}$. For example, in one application the rotor tip speed is about 40 m/s (7900 ft/min) and the shear gap width is 0.0254 mm (0.001 inch), producing a shear rate of 1,600,000 s$^{-1}$. In another application the rotor tip speed is about 22.9 m/s (4500 ft/min) and the shear gap width is 0.0254 mm (0.001 inch), producing a shear rate of about 901,600 s$^{-1}$.

In some embodiments, an HSD comprises a colloid mill. Suitable colloidal mills are manufactured by IKA® Works, Inc. Wilmington, N.C. and APV North America, Inc. Wilmington, Mass., for example. In some instances, an HSD comprises the DISPAX REACTOR® of IKA® Works, Inc.

In some embodiments, each stage of an HSD has interchangeable mixing tools, offering flexibility. For example, the DR 2000/4 DISPAX REACTOR® of IKA® Works, Inc. Wilmington, N.C. and APV North America, Inc. Wilmington, Mass., comprises a three stage dispersing module. This module may comprise up to three rotor/stator combinations (generators), with choice of fine, medium, coarse, and super-fine for each stage. This allows for variance of shear rate along the direction of flow. In some embodiments, each of the stages is operated with super-fine generator.

Figure 4:
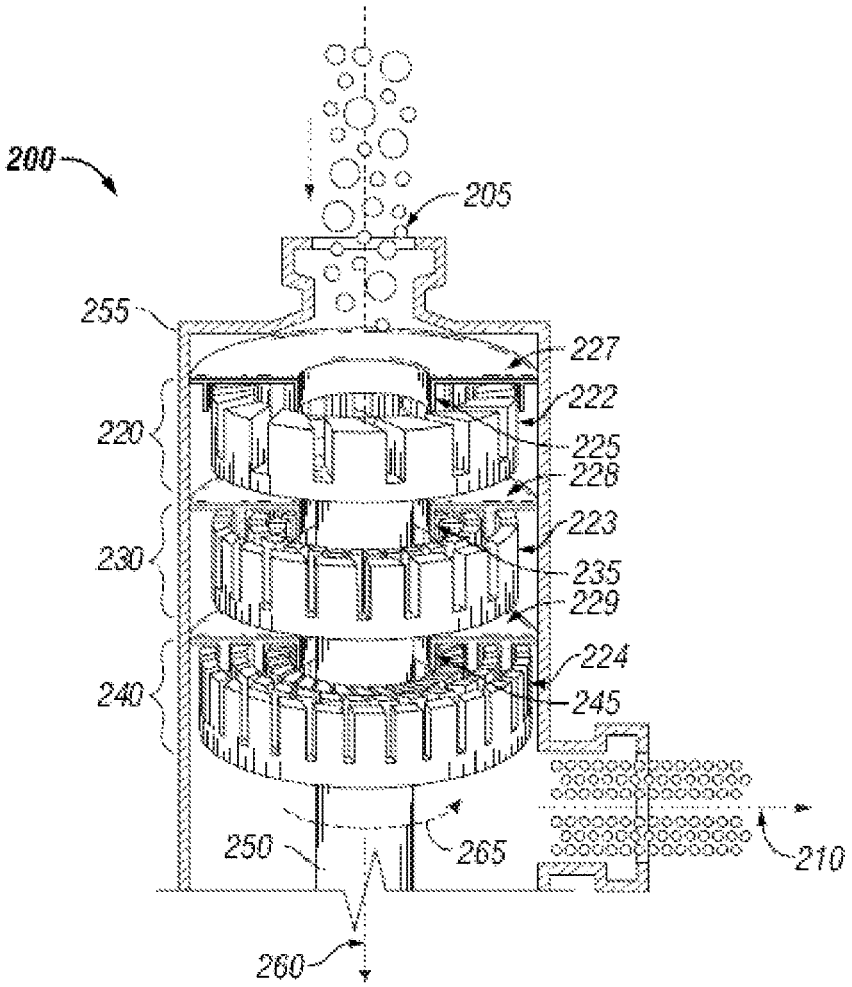
FIG. 4 is a longitudinal cross-section view of a high shear mixing device suitable for use in embodiments of the disclosed system.
Figure 5:
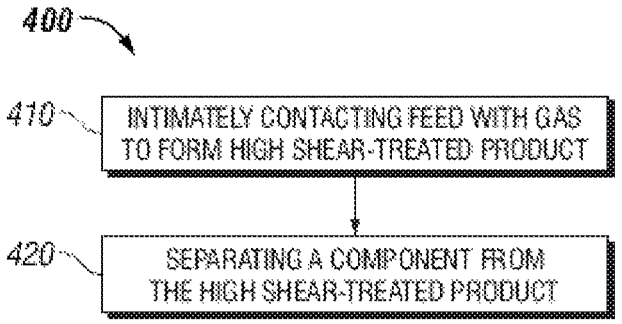
FIG. 5 is a box flow diagram of a method of removing a component from a stream produced in heavy oil or bitumen recovery and/or processing.

In embodiments, a scaled-up version of the DISPAX® reactor is utilized. For example, in embodiments HSD comprises a SUPER DISPAX REACTOR® DRS 2000. An HSD unit may be a DR 2000/50 unit, having a flow capacity of 125,000 liters per hour, or a DRS 2000/50 having a flow capacity of 40,000 liters/hour. Because residence time is increased in the DRS unit, the fluid therein is subjected to more shear. Referring now to FIG. 4, there is presented a longitudinal cross-section of a suitable device HSD 200 for use as an HSD in either of high shear systems 100 or 300. HSD 200 of FIG. 4 is a dispersing device comprising three stages or rotor-stator combinations, 220, 230, and 240. The rotor-stator combinations may be known as generators 220, 230, 240 or stages without limitation. Three rotor/stator sets or generators 220, 230, and 240 are aligned in series along drive shaft 250.

First generator 220 comprises rotor 222 and stator 227. Second generator 230 comprises rotor 223, and stator 228. Third generator 240 comprises rotor 224 and stator 229. For each generator the rotor is rotatably driven by shaft 250 and rotates about axis 260 as indicated by arrow 265. The direction of rotation may be opposite that shown by arrow 265 (e.g., clockwise or counterclockwise about axis of rotation 260). Stators 227, 228, and 229 may be fixably coupled to the wall 255 of HSD 200. As mentioned hereinabove, each rotor and stator may comprise rings of complementarily-shaped tips, leading to several shear gaps within each generator.

As mentioned hereinabove, each generator has a shear gap width which is the minimum distance between the rotor and the stator. In the embodiment of FIG. 4, first generator 220 comprises a first shear gap 225; second generator 230 comprises a second shear gap 235; and third generator 240 comprises a third shear gap 245. In embodiments, shear gaps 225, 235, 245 have widths in the range of from about 0.025 mm to about 10 mm. Alternatively, the process comprises utilization of an HSD 200 wherein the gaps 225, 235, 245 have a width in the range of from about 0.5 mm to about 2.5 mm. In certain instances the shear gap width is maintained at about 1.5 mm. Alternatively, the width of shear gaps 225, 235, 245 are different for generators 220, 230, 240. In certain instances, the width of shear gap 225 of first generator 220 is greater than the width of shear gap 235 of second generator 230, which is in turn greater than the width of shear gap 245 of third generator 240. As mentioned above, the generators of each stage may be interchangeable, offering flexibility. HSD 200 may be configured so that the shear rate remains the same or increases or decreases stepwise longitudinally along the direction of the flow.

Generators 220, 230, and 240 may comprise a coarse, medium, fine, and super-fine characterization, having different numbers of complementary rings or stages on the rotors and complementary stators. Rotors 222, 223, and 224 and stators 227, 228, and 229 may be toothed designs. Each generator may comprise two or more sets of complementary rotor-stator rings. In embodiments, rotors 222, 223, and 224 comprise more than 3 sets of complementary rotor/stator rings.

Each HSD may be a large or small scale device. In embodiments, system 100/300 is used to process from less than 100 gallons per minute to over 5000 gallons per minute. In embodiments, one or more HSDs process at least 100, 500, 750, 900, 1000, 2000, 3000, 4000, 5000 gpm or more. Large scale units may produce 1000 gal/h (24 barrels/h). The inner diameter of the rotor may be any size suitable for a desired application. In embodiments, the inner diameter of the rotor is from about 12 cm (4 inch) to about 40 cm (15 inch). In embodiments, the diameter of the rotor is about 6 cm (2.4 inch). In embodiments, the outer diameter of the stator is about 15 cm (5.9 inch). In embodiments, the diameter of the stator is about 6.4 cm (2.5 inch). In some embodiments the rotors are 60 cm (2.4 inch) and the stators are 6.4 cm (2.5 inch) in diameter, providing a clearance of about 4 mm. In certain embodiments, each of three stages is operated with a superfine generator comprising a number of sets of complementary rotor/stator rings.

HSD 200 is configured for receiving at inlet 205 a feed mixture from line 110/310. The feed may include bitumen, heavy crude, tailings, etc. Feed stream entering inlet 205 is pumped serially through generators 220, 230, and then 240, such that a sheared product stream is produced. High shear-treated product exits HSD 200 via outlet 210 (and lines 150/350 of FIGS. 1/2). The rotors 222, 223, 224 of each generator rotate at high speed relative to the fixed stators 227, 228, 229, providing a high shear rate. The rotation of the rotors pumps fluid, such as the feed stream entering inlet 205, outwardly through the shear gaps (and, if present, through the spaces between the rotor teeth and the spaces between the stator teeth), creating a localized high shear condition. High shear forces exerted on fluid in shear gaps 225, 235, and 245 (and, when present, in the gaps between the rotor teeth and the stator teeth) through which fluid flows process the fluid and create high shear product. The product comprises a high shear product stream. High shear-treated product may exit HSD 200 via high shear outlet 210 (line 150/350 of FIGS. 1/2).

Without wishing to be limited by theory, it is believed that the high shear product at 210 may comprise an abundance of free radicals. The shear provided by the high velocity may generate numerous micronized or comminuted solid particles or globules. The high velocity, associated surface phenomenon, and other dissociating forces may generate the free radicals in the product. This high shear-treated product may be reactive and may remain in a reactive state for substantial time periods, (e.g., 30 minutes or more in some instances), even upon exiting the HSD.

As mentioned above, in certain instances, HSD 200 comprises a DISPAX REACTOR® of IKA® Works, Inc. Wilmington, N.C. and APV North America, Inc. Wilmington, Mass. Several models are available having various inlet/outlet connections, horsepower, tip speeds, output rpm, and flow rate. Selection of the HSD will depend on throughput selection, for example. IKA® model DR 2000/4, for example, comprises a belt drive, 4M generator, PTFE sealing ring, inlet flange 25.4 mm (1 inch) sanitary clamp, outlet flange 19 mm (¾inch) sanitary clamp, 2 HP power, output speed of 7900 rpm, flow capacity (water) approximately 300-700 L/h (depending on generator), a tip speed of from 9.4-41 m/s (1850 ft/min to 8070 ft/min). Scale up may be performed by using a plurality of HSDs, or by utilizing larger HSDs. Scale-up using larger models is readily performed, and results from larger HSD units may provide improved efficiency in some instances relative to the efficiency of lab-scale devices. The large scale unit may be a DISPAX® 2000/unit. For example, the DRS 2000/5 unit has an inlet size of 51 mm (2 inches) and an outlet of 38 mm (1.5 inches).

In embodiments, any of the HSDs, or portions thereof, are manufactured from refractory/corrosion resistant materials. For example, sintered metals, INCONEL® alloys, HASTELLOY® materials may be used. For example, when the mixture is or comprises caustic the rotors, stators, and/or other components of the HSD may be manufactured of refractory materials (e.g. sintered metal) in various applications.

Separation Apparatus 160/360. As discussed hereinabove, the high shear system comprises a separation apparatus 160/360 configured to separate one or more components from the high shear-treated product stream introduced thereto via high shear-treated product stream outlet line 150/350. Separation units 160/360 may be selected from centrifuges, settling tanks, filtration units, and the like, as known in the art. In embodiments, separation unit 160/360 comprises one or more centrifuges. Separation apparatus 160/360 comprises an outlet 170/370 for removed component, and an outlet 180/380 for component-reduced product. Separation apparatus 160 may further comprise a gas outlet line 175 for removal of gas from separation apparatus 160.

Separation unit 160/360 may be operable continuously, semi-continuously, or batchwise. Separation apparatus 160/360 may comprise one or more unit(s) configured in series, configured in parallel, or some combination thereof. For parallel operation, outlet line 150/350 may divide to introduce high shear-treated product into multiple units 160/360.

Settling Tank 390. As indicated in FIG. 2 and discussed hereinabove, the high shear system may further comprise an additional separation unit, such as settling tank 390 in the embodiment of FIG. 2. High shear system 100/300 may comprise one or more settling tanks 390. Settling tank 390 is any suitable apparatus configured to provide a suitable residence time for the separation of an oil phase from an aqueous phase, gaseous phase from liquid phase, and/or gas/liquid/solid separation. In an embodiment, settling tank(s) 390 comprises an outlet for an aqueous phase and an outlet for an oil phase.

Heat Transfer Devices. Internal or external heat transfer devices are also contemplated in variations of the system. For example, the reactants may be preheated via any method known to one skilled in the art. Some suitable locations for one or more such heat transfer devices are upstream of the HSD, between the HSD and flow line 150/350, and within or subsequent separation apparatus 160/360. HSD may comprise an inner shaft which may be cooled, for example water-cooled, to partially or completely control the temperature within the HSD. Some non-limiting examples of such heat transfer devices are shell, tube, plate, and coil heat exchangers, as are known in the art.

Pumps. The high shear system may comprise one or more pumps configured for either continuous or semi-continuous operation, and may be any suitable pumping device that is capable of providing controlled flow through each HSD of the high shear systems 100, 300. In applications the one or more pump provides greater than 202.65 kPa (2 atm) pressure or greater than 303.97 kPa (3 atm) pressure. The one or more pump may be a Roper Type 1 gear pump, Roper Pump Company (Commerce Ga.) Dayton Pressure Booster Pump Model 2P372E, Dayton Electric Co (Niles, Ill.) is one suitable pump. In embodiments, all contact parts of the pump comprise stainless steel, for example, 316 stainless steel. In some embodiments of the system, the one or more pump is capable of pressures greater than about 2026.5 kPa (20 atm).

In embodiments, a high shear system as described in the embodiment of FIG. 1 is incorporated into a hot water extraction system as depicted in FIG. 3. For example, one or more high shear system(s) may be incorporated into a hot water extraction process at locations indicated with arrows A, B, C, D and/or E, or elsewhere throughout an extraction system. In such embodiments, asphaltene removal may be provided by fluidly connecting a bitumen line, such as on line 20 (before or after pump 21) as indicated by arrows C and D, on line 30 as indicated by arrow E, 32, 38, 44, or 48 into HSD 140. A high shear system 100 may be incorporated as indicated at arrow B. In embodiments, a high shear system as described in the embodiment of FIG. 2 is incorporated into a hot water extraction system as depicted in FIG. 3. In such embodiments, water may be recovered from the tailings by introducing tailings from tailings pond 52 into high shear system 300 as indicated at arrow A. In this manner, water may be more rapidly recovered and recycled to tumbler 18, and bitumen recovery may be enhanced. In embodiments, a high shear system(s) is incorporated at arrow C, D, and/or E. Each of the locations could optionally have addition of $CO_2$ and/or other compounds that cause the asphaltene to drop out after reacting in the high shear unit. One or more diluents, such as, but not limited to, naphtha and/or propane, may be added along with heat at any point in the system/process to reduce viscosity and/or aid in transporting the bitumen. Such diluents may subsequently be removed and/or reused.

High Shear Method for Removing a Component from a Stream Produced During Recovery and/or Processing of Heavy Crude Oil or Bitumen. A method of removing a solid component from a stream produced during recovery and/or treatment of heavy crude oil or bitumen will now be described with respect to FIG. 4, which is a schematic of a high shear method 400 of removing a desired component from a feed according to an embodiment of this disclosure. Method 400 comprises intimately processing a feed stream in a high shear device to form a high shear-treated product at 410 and separating a solid component therefrom at 420. For ease of description, a method of removing asphaltenes from asphaltenic bitumen and/or heavy crude oil will now be made, but embodiments disclosed herein are not limited, and are suitable to processing other hydrocarbonaceous feed streams.

Method of Improving Bitumen Extraction from Tar Sands. In embodiments, a high shear method is provided for improving bitumen extraction from tar sands. This method may be utilized to enhance bitumen separation from inorganic materials (mostly sand and clay) following excavation or extraction from the ground.

For example, with reference now to FIG. 3, which depicts a prior art hot water bitumen processing system, hot water and a conditioning agent or base (usually caustic soda; i.e. sodium hydroxide) are added to the bitumen to aid separation of the bitumen from the inorganic components. Other bases, such as sodium sesquicarbonate, may also be utilized. (See, for example, U.S. Pat. App. No. 2002/0104799 by Humphreys et al.) Hot water processing is usually performed in large tumblers 18 to aid in mixing. The slurry from the tumblers 18 is screened through screen 22 to separate the larger debris and passed to a separation cell 24 where settling time is provided to allow the slurry to separate. As the slurry settles, the bitumen froth rises to the surface and the sand particles and sediments fall to the bottom. A middle viscous sludge layer, termed middlings, contains dispersed clay particles and some trapped bitumen which is not able to rise due to the viscosity of the sludge. Once the slurry has settled, the froth is skimmed off via line 30 for froth treatment and the sediment layer is passed via line 27 to a tailings pond 52. The middlings 26 may be fed to a secondary separation cell 28 of froth flotation for further bitumen froth recovery. Tailings from secondary separation cell 28 may be sent via line 51 to tailings pond 52.

In other embodiments, a modified hot water extraction process termed the hydrotransport process is used to mix tar sand with hot water and caustic at the mine site and the resultant slurry is transported to the separation cell 24 in a large pipe. During the hydrotransport, tar sand is conditioned and the bitumen is aerated to form a froth. The hydrotransport system replaces the manual or mechanical transport of the tar sands to the separation cell and eliminates the need for tumblers 18.

The bitumen froth in line 30 from either process contains bitumen, solids and trapped water. The solids which are present in the froth are in the form of clays, silt and some sand. From the separation cell 24 the froth is passed via a line 30 to a defrother vessel 34 where the froth is heated and broken to remove the air. Naphtha is then added via line 33 to cause a reduction in the density of the bitumen, facilitating separation of the bitumen from the water by means of a subsequent centrifuge treatment. The centrifuge treatment first includes a gross centrifuge separation in coarse centrifuge 40 followed by fine centrifuge 46. The bitumen collected from the centrifuge treatment in line 48 may contain less than 2% water and solids and can be passed to the refinery for upgrading. The water and solids released during the centrifuge treatment and extracted from coarse centrifuge 40 via line 42 and extracted from fine centrifuge 46 via line 50 may also be passed to tailings pond 52.

Typically, the tailings in a conventional tailings pond comprise a sludge of caustic soda, sand and water with some bitumen. During the initial years of residence time, some settling takes place in the upper layer of the pond, releasing some of the trapped water. The water released from the ponds can be recycled back into the hot water process. The major portion of the tailings remains as sludge indefinitely. The sludge contains some bitumen and a high percentages of solids, mainly in the form of suspended silt and clay.

The tailings ponds are costly to build and maintain. The size of the ponds and their characteristic caustic condition creates serious environmental problems. In addition, environmental concerns exist over the large quantity of water which is required for extraction and which remains locked in the tailings pond after use.

It is known that sludge is formed in the initial conditioning of the tar sand, when the caustic soda attacks the sand and clay particles. The caustic soda causes the clays to swell and disburse into platelets which remain dispersed, inhibiting settling. These platelets are held in suspension and form the gel-like sludge. Such sludge inhibits the flotation of the bitumen froth in the extraction process. Expanding-type clays, such as the montmorillanite clays, are particularly susceptible to caustic attack. Because of the problems caused by sludge formation and the low bitumen recovery available from highly viscous sludges, lower grade tar sands containing high levels of expanding-type clays cannot be treated satisfactorily using the conventional hot water extraction process. The disclosed extraction process allows a reduction in the production of sludge, and therefore an increase in the water available for recycling. Such a process provides the possibility of increased bitumen recovery from lower grade ores.

Referring now to FIG. 4, a method 400 of separating a solid component from a feed stream includes processing a feed stream in a high shear device to form a high shear-treated product 410 and then separating at least a portion of the solid component from the shear-treated product 420. The high shear processing of the feed stream comminutes at least a portion of the solid component of the feed stream. As the solid component of the feed stream is comminuted, the particles reduce in size and release gas that is trapped within the structure of the solid particles. Releasing gas from the solid particles increases the density of the comminuted particles relative to the non-comminuted particles. Therefore, the solid particles that have been comminuted by the high-shear treatment will tend to settle out of the feed stream faster than particles that are not comminuted.

Settling aids may be added at any point in the process where settling needs to be enhanced. Settling aids such as polyacrylate and polyacrylamide polymers and alum and their application are known to those experienced in the art.

As discussed above, the feed (e.g., tailings) may be obtained by any means known in the art, for example as described hereinabove with respect to the prior art hot water process of FIG. 3. In this embodiment, processing comprises subjecting the feed mixture (tailings), which may be introduced from tailings pond, to high shear directly into HSD 340, to produce a high shear-treated product. With respect to FIG. 2, the high shear-treated stream exiting HSD 340 via line 350 may be in the form of a product stream comprising micron and/or submicron size particles or globules. For example, solid particles may have a mean diameter of less than about 1 μm, less than 0.5 μm, or less than 0.4 μm. In embodiments, the particles in the shear product stream may have an average particle diameter in the nanometer range, the micron range, or the submicron range. In embodiments, subjecting the feed mixture to high shear comprises subjecting to a shear rate of at least 10,000 $s^{-1}$, at least 20,000 $s^{-1}$, at least 30,000 $s^{-1}$, or higher, as further discussed herein.

Referring now to FIG. 2, intimately mixing the feed mixture 310 at 410 comprises introducing the feed mixture 310 into HSD 340. The feed mixture may be pumped into HSD 340. The feed mixture may be pumped through line 310, to build pressure and feed HSD 340, providing a controlled flow throughout HSD 340 and high shear system 300. In some embodiments, the pressure of the HSD inlet stream in line 310 is increased to greater than 200 kPa (2 atm) or greater than about 300 kPa (3 atmospheres). In this way, high shear system 300 may combine high shear with pressure to enhance production of bicarbonate and separation and recovery of water.

The temperature, shear rate and/or residence time within HSD 340 may be controlled to effect desired sheared product. In embodiments, the feed has a pH of about 10 and the pH of the high shear-treated stream is less than about 6, such that solids and oil are easily removed from the water via centrifuge 360 and settling tank 390, respectively. In some aspects of embodiments disclosed herein the high shear device will cause formation of micelles due to the presence of surface active agents in the bitumen mix. Micelle formation may aid in bitumen mix flow and will be broken once water is removed.

In an exemplary embodiment, the high shear device comprises a commercial disperser such as IKA® model DR 2000/4, a high shear, three stage device configured with three rotors in combination with stators, aligned in series, as described above. The device is operated to subject the contents to high shear. The rotor/stator sets may be configured as illustrated in FIG. 4, for example. In such an embodiment, the feed comprising tailings enters high shear device 340 via line 310 and enters a first stage rotor/stator combination having circumferentially spaced first stage shear openings. The coarse mixture exiting the first stage enters the second rotor/stator stage, which has second stage shear openings. The mixture emerging from the second stage enters the third stage rotor/stator combination having third stage shear openings. The rotors and stators of the generators may have circumferentially spaced complementarily-shaped rings. A high shear-treated product exits the high shear device via outlet 210 (line 350 in FIG. 2).

In some embodiments, the shear rate increases stepwise longitudinally along the direction of the flow, or going from an inner set of rings of one generator to an outer set of rings of the same generator. In other embodiments, the shear rate decreases stepwise longitudinally along the direction of the flow, or going from an inner set of rings of one generator to an outer set of rings of the same generator (outward from axis 260). For example, in some embodiments, the shear rate in the first rotor/stator stage is greater than the shear rate in subsequent stage(s). For example, in some embodiments, the shear rate in the first rotor/stator stage is greater than or less than the shear rate in a subsequent stage(s). In other embodiments, the shear rate is substantially constant along the direction of the flow, with the stage or stages being the same. If high shear device 340 includes a PTFE seal, for example, the seal may be cooled using any suitable technique that is known in the art. The high shear device may comprise a shaft in the center which may be used to control the temperature within high shear device 340.

The rotor(s) of high shear device 340 may be set to rotate at a speed commensurate with the diameter of the rotor and the desired tip speed. As described above, the high shear device (e.g., colloid mill or toothed rim disperser) has either a fixed clearance between the stator and rotor or has adjustable clearance.

In some embodiments, high shear device 340 delivers at least 300 L/h at a nominal tip speed of at least 22 m/s (4500 ft/min), 40 m/s (7900 ft/min), and which may exceed 225 m/s (45,000 ft/min) or greater. The power consumption may be about 1.5 kW or higher as desired. Although measurement of instantaneous temperature and pressure at the tip of a rotating shear unit or revolving element in high shear device 340 is difficult, it is estimated that the localized temperature seen by the intimately mixed reactants may be in excess of 500° C. and at pressures in excess of 500 kg/$cm^2$ under high shear conditions.

Conditions of temperature, pressure, space velocity, and/or ratio of reactant gas to tailings may be adjusted to effect substantially complete conversion of caustic in the tailings to bicarbonate, enhancing subsequent component separation. The global temperature and/or the temperature of the feed mixture introduced into high shear device 340 may be in the range of from about 5° C. to about 95° C. In embodiments, the global temperature is ambient temperature. In embodiments, the global operating temperature is room temperature.

The residence time within high shear device 340 is typically low. For example, the residence time can be in the millisecond range, can be about 10, 20, 30, 40, 50, 60, 70, 80, 90 or about 100 milliseconds, can be about 100, 200, 300, 400, 500, 600, 700, 800, or about 900 milliseconds, can be in the range of seconds, or can be any range thereamong.

In this embodiment, separating a component from the high shear-treated product at 420 comprises introducing the high shear-treated stream into a centrifuge 360. Centrifuge 360 is operated to separate solids from liquid. Solids are removed from centrifuge 360 via solids outlet line 370. Separating a component from the high shear-treated product at 420 further comprises introducing the solids-reduced product into settling tank 390 via line 380. Within settling tank 390, an aqueous phase is separated from an oil phase. The oil phase may be combined with product bitumen in line 30 or 48 of FIG. 3, for example, when high shear system 300 is incorporated into such a hot water caustic bitumen extraction process.

The high shear processing of the tailings reduces settling times for the sludge (tailings). The oil may be floated to the top of settling tank 390 and removed, for example, skimmed off the surface. The presence of air may aid in the flotation of oil in settling tank 390. The water removed may be sent for further treatment, for example to a bio-pond, prior to discharge or may be recycled to the bitumen extraction process, minimizing the amount of fresh water needed for processing relative to conventional methods.

In embodiments, the water removed from settling tank 390 comprises less than 1 weight percent, less than 0.5 weight percent, or less than 0.1 weight percent of total suspended solids (TSS). This water may be aerated, treated and discharged or recycled back to process.

Method of Removing Asphaltenes from Heavy Crude Oil/Bitumen. The high shear method will now be described with reference to the removal of asphaltenes from asphaltenic oil. The asphaltenic oil may comprise heavy crude oil or bitumen. Description of this method will now be provided with reference to FIGS. 1 and 3. Asphaltenes are complex organic materials that are arranged in stacked, multi-ring structures that possess very high boiling point polyaromatic hydrocarbons. The exact molecular structure of asphaltenes is not known because of the complexity of the asphaltene molecules. Therefore, the definitions of asphaltenes are based on their solubility. Generally, asphaltenes are the fraction of oil that is insoluble in paraffinic solvents such as n-heptane or n-pentane, and soluble in aromatic solvents such as benzene or toluene. Asphaltenes contain nitrogen, sulfur and oxygen atoms in addition to carbon and hydrogen atoms within the repeating unit. Asphaltenes are not truly soluble in crude oil. They exist as 35-40 micron platelets that are maintained in suspension by materials known as maltenes and resins. When stabilizing factors are altered, the asphaltenes coalesce under certain pressure, temperature and compositional conditions. It is generally understood that the API gravity goes down with increasing asphaltene content.

The major destabilizing forces for asphaltenes, as described in the book *Asphaltene and Asphalts* (Yen and Chilingar-1994), include $CO_2$ injection, miscible flooding, pH shift, mixing of crude streams, and the presence of incomplete organic chemicals. The role of carbon dioxide in destabilizing asphaltene-crude oil is well-documented. Some degree of asphaltene precipitation is noted in wells in every $CO_2$ flooding operation, with the most notable asphaltene precipitation being in the well-bore and the pump regions. Miscible flooding causes asphaltene destabilization because straight chain hydrocarbons have less affinity for asphaltene ring structures. In analytical tests, heptane is normally used in crude oil to reject asphaltene. A shift in pH can be invoked by $CO_2$, mineral acids or naturally occurring acids and can destabilize asphaltenes. Asphaltene precipitation can also be induced by high shear or perturbation caused by cavitations in some pumps or mixing manifolds. Some chemicals, such as methyl alcohol which does not have an aromatic ring, may selectively attract or wet the maltenes or resins and cause agglomeration of asphaltenes.

In this embodiment, the high shear method is utilized to effect enhanced removal of asphaltenes from asphaltenic oil by subjecting the asphaltenic oil to high shear. In this embodiment, processing the feed under high shear conditions 410 results in high shear-treated product that includes asphaltenic heavy crude oil and/or bitumen (i.e., heavy crude oil comprising asphaltenes and/or bitumen comprising asphaltenes) with solid particles approaching skeletal density. The processing may be performed substantially as described above. With reference to FIG. 1, bitumen or heavy crude oil is introduced into HSD 140. Water may be added to HSD 140 in some applications. High shear-treated product exits HSD 140 via HSD outlet line 150.

Specifically, the feed (bitumen or heavy crude oil) may be obtained by any means known in the art, for example a bitumen feed may be obtained as described hereinabove with respect to the prior art hot water bitumen extraction process of FIG. 3. As indicated in FIG. 1, water may be introduced into HSD 140 via separate inlet line 130 or may be combined with or present in feed line 110. With respect to FIG. 1, the high shear treated stream exiting HSD 140 via line 150 may be in the form of a product stream having sheared solids with a reduced inner porosity as compared to solids before processing. In the high shear device, solids are essentially disintegrated to the point that any components initially retained within the solids, such as gas or tar, are released into the product stream. In embodiments, processing the feed mixture in the high shear device may include subjecting the feed to a shear rate of at least 10,000 $s^{-1}$, at least 20,000 $s^{-1}$, at least 30,000 $s^{-1}$, or higher, as further discussed herein.

Referring again to FIG. 1, processing the feed mixture comprises introducing the feed mixture into HSD 140. The feed mixture may be pumped into HSD 140. The feed mixture may be pumped through feed line 110, to build pressure and feed HSD 140, providing a controlled flow throughout high shear device (HSD) 140 and high shear system 100. In some embodiments, the pressure of the HSD inlet stream in feed line 110 is increased to greater than 200 kPa (2 atm) or greater than about 300 kPa (3 atmospheres). In this way, high shear system 100 may combine high shear with pressure to enhance destabilization and subsequent separation of asphaltenes from the feed oil.

The temperature, shear rate and/or residence time within HSD 140 may be controlled to effect desired asphaltene destabilization. Experiments may be performed to determine the minimum amount of carbon dioxide needed to effect a desired degree of asphaltene removal.

Subjecting the feed mixture to high shear may produce a high shear product stream that includes solid particles or globules dispersed throughout a liquid phase. In embodiments, a product stream comprising nano- or micro-size particles is formed. In embodiments, the particles in the product stream have an average diameter of less than or about 5, 4, 3, 2 or 1 μm. In embodiments, the particles in the product stream have an average particle diameter in the nanometer range, the micron range, or the submicron range.

In an exemplary embodiment, the high shear device comprises a commercial disperser such as IKA® model DR 2000/4, a high shear, three stage dispersing device configured with three rotors in combination with stators, aligned in series, as described above. The disperser is operated to subject the contents to high shear. The rotor/stator sets may be configured as illustrated in FIG. 4, for example. In such an embodiment, the feed comprising asphaltenic oil enters high shear device 140 via feed line 110 and enters a first stage rotor/stator combination having circumferentially spaced first stage shear openings. The coarse mixture exiting the first stage enters the second rotor/stator stage, which has second stage shear openings. The mixture emerging from the second stage enters the third stage rotor/stator combination having third stage shear openings. The rotors and stators of the generators may have circumferentially spaced complementarily-shaped rings. A high shear-treated product exits the high shear device via outlet 210 (line 150 in FIG. 1).

In some embodiments, the shear rate increases stepwise longitudinally along the direction of the flow, or going from an inner set of rings of one generator to an outer set of rings of the same generator. In other embodiments, the shear rate decreases stepwise longitudinally along the direction of the flow, or going from an inner set of rings of one generator to an outer set of rings of the same generator (outward from axis 260). For example, in some embodiments, the shear rate in the first rotor/stator stage is greater than the shear rate in subsequent stage(s). For example, in some embodiments, the shear rate in the first rotor/stator stage is greater than or less than the shear rate in a subsequent stage(s). In other embodiments, the shear rate is substantially constant along the direction of the flow, with the stage or stages being the same. If HSD 140 includes a PTFE seal, for example, the seal may be cooled using any suitable technique that is known in the art. The HSD may comprise a central shaft which may be used to control the temperature within HSD 140.

The rotor(s) of HSD 140 may be set to rotate at a speed commensurate with the diameter of the rotor and the desired tip speed. As described above, the HSD (e.g., colloid mill or toothed rim disperser) has either a fixed clearance between the stator and rotor or has adjustable clearance.

In some embodiments, HSD 140 delivers at least 300 L/h at a nominal tip speed of at least 22 m/s (4500 ft/min), 40 m/s (7900 ft/min), and which may exceed 225 m/s (45,000 ft/min) or greater. The power consumption may be about 1.5 kW or higher as desired. Although measurement of instantaneous temperature and pressure at the tip of a rotating shear unit or revolving element in HSD 140 is difficult, it is estimated that the localized temperature seen by the intimately mixed reactants may be in excess of 500° C. and at pressures in excess of 500 kg/cm$^2$ under high shear conditions.

Conditions of temperature, pressure, space velocity, etc. may be adjusted to effect substantially complete destabilization and subsequent removal of asphaltenes. The global temperature and/or the temperature of the feed mixture introduced into HSD 140 may be in the range of from about 10° C. to about 200° C. In embodiments, the global temperature is ambient temperature. In embodiments, the global operating temperature is room temperature.

The residence time within HSD 140 is typically low. For example, the residence time can be in the millisecond range, can be about 10, 20, 30, 40, 50, 60, 70, 80, 90 or about 100 milliseconds, can be about 100, 200, 300, 400, 500, 600, 700, 800, or about 900 milliseconds, can be in the range of seconds, or can be any range there among.

In this embodiment, separating a component (e.g., solid component, solids, released gas, etc.) from the high shear-treated product 420 comprises introducing the high shear-treated product in line 150 into a separation device, such as a settler or centrifuge 160. Asphaltenes are removed from centrifuge 160 via outlet line 170 and may be sent for further processing as known in the art. Oil from which asphaltenes have been removed (i.e., lighter crude oil or asphaltene-reduced bitumen) is removed from centrifuge 160 via line 180. Due to the removal of asphaltenes, the API gravity of the product oil in line 180 is generally greater than the API gravity of the feed oil (e.g. asphaltenic bitumen or heavy crude oil) introduced into high shear system 100 via feed line 110. In embodiments, the API gravity of the oil in line 180 is greater than about 7, greater than about 12, greater than about 15, or greater than about 17. In embodiments, the API gravity of the material in feed line 110 is less than about 10, less than about 7 or less than about 5. Transportation of the asphaltene-reduced oil removed from centrifuge 160 via line 180 is thus facilitated relative to transport of the heavy crude oil or asphaltic bitumen introduced into high shear system 100 via feed line 110. Gas may be removed from centrifuge 160 via gas outlet line 175. The carbon dioxide may be recycled to HSD 140.

Desirably, this process is performed subsequent removal of the majority of the clay, sand and other inorganics from the tar sands. For example, as indicated in FIG. 3, HSD 140 may be positioned downstream of one or more tumblers 18, downstream of one or more screens 22, downstream of one or more separation cells 24, and/or downstream of one or more secondary separation cells 28.

In embodiments, the operating temperature and pressure for asphaltene removal are mild. In embodiments, the operating temperature throughout high shear system 300 and/or HSD 140 is in the range of from about room temperature to about 100° C. In embodiments, the operating pressure is in the range if from about 0 to about 60 psig. The resulting liquid oil in product line 180 can be easily transported in pipelines with or without diluents. Advantages to this method of asphaltene removal may include: (1) a reduction in distillation cost of conventionally-used diluent; (2) a reduction in transportation cost of diluents; (3) removal of sand, clay and other inorganic contaminants from feed (e.g. heavy crude oil) along with removal of asphaltenes; (4) asphaltene removal in situ; (5) concomitant reduction in heavy metals; (6) reduction in pipeline fouling and cleaning costs due to sand asphaltene precipitation; (7) partial sulfur removal; and (8) operation in the presence or absence of water (as mentioned hereinabove, conventional solvent deasphalting is intolerant to the presence of water).

In embodiments, the product oil exiting the high shear system comprises less than 10 wt %, 5 wt %, 3 wt %, or 1 wt % of impurities selected from asphaltenes, sand, silt and other solids. In embodiments, the product oil in line 180 comprises from about 95 to about 99 wt % bitumen, from about 5 wt % to about 1 wt % water, and from about 2% to about 0.5 wt % solids. In embodiments, the product oil in line 180 comprises less than 10 wt %, 3 wt %, or 1 wt % asphaltenes. In embodiments, the product oil in line 180 comprises less than 1 wt %, 0.5 wt %, or 0.1 wt % total dissolved solids (TDS), such as, without limitation, silt, sand, fines and other particulate matter. In embodiments, the product oil in line 180 comprises less than 5 wt %, 2 wt %, or 1 wt % water. In embodiments, the product oil has an API gravity of greater than 8, 10, or 15. In embodiments, the feed comprising bitumen or heavy crude oil introduced into HSD via feed line 110 has an API gravity in the range of from about 7 to about 10, from about 10 to about 15, or from about 15 to about 25. In embodiments, utilization of the disclosed system and method provides at least about a 30, 40, 50, 60, 70, or 80% reduction in the amount of impurities (e.g., asphaltenes, solids, water or heavy metals) in the bitumen or heavy crude oil fed to HSD 140 via feed line 110. Concomitantly, utilization of the disclosed system and method may provide a significant cost savings by enabling utilization of less downstream purification equipment, reduced-size equipment, and/or reduced down-time for cleaning due to plugging, etc. The system and method may be operable to provide greater than 5, 10, or 20 tons/h of component reduced oil in line 180, 380 and/or 386.

Multiple Pass Operation. In the embodiments shown in FIGS. 1 and 2, the systems are configured for single pass operation. However, the output of HSD may be run through a subsequent HSD. In some embodiments, it may be desirable to pass the contents of flow line 150/350, flow line 180/380 or a fraction thereof, through HSD during a second pass. In this case, at least a portion of the contents of flow line 150/350 or 180/380 may be recycled back into the same and/or a subsequent HSD. Due to the rapidity of the interactions within the HSD, multiple pass operation may not be necessary or desirable.

Various dimensions, sizes, quantities, volumes, rates, and other numerical parameters and numbers have been used for purposes of illustration and exemplification of the principles of the invention, and are not intended to limit the invention to the numerical parameters and numbers illustrated, described or otherwise stated herein. Likewise, unless specifically stated, the order of steps is not considered critical. The different teachings of the embodiments discussed herein may be employed separately or in any suitable combination to produce desired results.

While preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, and so forth). Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the preferred embodiments of the present invention. The disclosures of all patents, patent applications, and publications cited herein are hereby incorporated by reference, to the extent they provide exemplary, procedural or other details supplementary to those set forth herein.

What is claimed is:

1. A method comprising:

shearing a feed comprising a solid component in a first high shear device to produce a product, at least a portion of which comprises sheared solids;

separating at least some of the sheared solids from the product to produce a component-reduced product and a heavy component comprising the at least some of the sheared solids;

introducing the heavy component and at least one component selected from the group consisting of emulsifiers, water, and carbon dioxide into a second high shear device, and recovering a hydrocarbon stream and a remaining product stream comprising water therefrom; and combining the component-reduced product and the recovered hydrocarbon stream to produce a mixed component product stream, wherein the solid component in the feed stream comprises a first particle density, and wherein the sheared solids in the product comprise a second particle density greater than the first particle density.

2. The method of claim 1, wherein the solid component of the feed comprises gas trapped therein, and wherein at least a portion of said gas is released from the solid component upon shearing.

3. The method of claim 2, wherein the gas comprises carbon dioxide.

4. The method of claim 2, wherein the feed comprises tailings from a caustic bitumen extraction process, and the component-reduced product comprises water having less than 10 wt % impurities.

5. The method of claim 4, wherein at least a portion of the tailings is produced by mixing tar sand and water in a tumbler or a hydrotransport line to form a froth; introducing the froth into a separation cell; and removing the at least a portion of the tailings from the separation cell.

6. The method of claim 2, wherein the feed comprises a liquid phase comprising tailings, asphaltenic oil, or a combination thereof, and the method further comprises shearing at a shear rate of at least 10,000 $s^{-1}$.

7. The method of claim 2, wherein separating at least some of the sheared solids from the product comprises separating the gas from the sheared solids in a settler.

8. The method of claim 2, wherein the solid component is suspended in the feed, and wherein the first high shear device comminutes the solid component.

9. The method of claim 1, wherein the solid component comprises a first internal porosity greater than an internal porosity of the sheared solids.

10. The method of claim 1, wherein the feed comprises asphaltenic oil, and the component-reduced product comprises asphaltene-reduced oil.

11. The method of claim 10, wherein the asphaltene-reduced oil comprises at least about 90 wt % bitumen.

12. The method of claim 11, wherein the asphaltene-reduced oil comprises less than about 10 wt % asphaltenes.

13. The method of claim 11, wherein the asphaltenic oil is selected from the group consisting of bitumen, heavy crude oils, and combinations thereof.

14. The method of claim 1, wherein combining the component-reduced product and the recovered hydrocarbon stream to produce a mixed component product stream comprises introducing the component-reduced product and the recovered hydrocarbon stream into a third high shear device from which the mixed product stream is extracted.

15. The method of claim 14 further comprising combining additional hydrocarbons with the component-reduced product and the recovered hydrocarbon stream to produce the mixed component product stream.

16. The method of claim 14 further comprising introducing a gas and the remaining product stream comprising water into a fourth high shear device.

17. The method of claim 16, wherein the gas comprises air, chlorine, or both.

18. The method of claim 1 further comprising combining additional hydrocarbons with the component-reduced product and the recovered hydrocarbon stream to produce the mixed component product stream.

19. The method of claim 1, wherein shearing the feed comprising the solid component in the first high shear device to produce the product further comprises contacting the solid component with carbon dioxide, water, or both in the first high shear device.

20. The method of claim 1 further comprising introducing a gas and the remaining product stream comprising water into a third high shear device.

21. The method of claim 20, wherein the gas comprises air, chlorine, or both.

22. The method of claim 20, wherein combining the component-reduced product and the recovered hydrocarbon stream to produce a mixed component product stream comprises introducing the component-reduced product and the recovered hydrocarbon stream into a fourth high shear device from which the mixed product stream is extracted.

23. The method of claim 22 further comprising combining additional hydrocarbons with the component-reduced product and the recovered hydrocarbon stream to produce the mixed component product stream.

* * * * *